US011192361B2

(12) United States Patent
Katakura et al.

(10) Patent No.: US 11,192,361 B2
(45) Date of Patent: Dec. 7, 2021

(54) LIQUID DISCHARGING HEAD AND LIQUID DISCHARGING APPARATUS

(71) Applicant: SEIKO EPSON CORPORATION, Tokyo (JP)

(72) Inventors: Takahiro Katakura, Okaya (JP); Hirofumi Sakai, Shiojiri (JP); Keigo Sugai, Chino (JP); Shinichi Nakamura, Okaya (JP)

(73) Assignee: SEIKO EPSON CORPORATION, Tokyo (JP)

( * ) Notice: Subject to any disclaimer, the term of this patent is extended or adjusted under 35 U.S.C. 154(b) by 0 days.

(21) Appl. No.: 16/722,600

(22) Filed: Dec. 20, 2019

(65) Prior Publication Data

US 2020/0207081 A1 Jul. 2, 2020

(30) Foreign Application Priority Data

Dec. 27, 2018 (JP) ..... JP2018-244292

(51) Int. Cl.
*B41J 2/045* (2006.01)
*B41J 2/145* (2006.01)
*B41J 2/14* (2006.01)

(52) U.S. Cl.
CPC ..... *B41J 2/04581* (2013.01); *B41J 2/145* (2013.01); *B41J 2/1433* (2013.01)

(58) Field of Classification Search
CPC ..... B41J 2/1433; B41J 2002/14475
See application file for complete search history.

(56) References Cited

U.S. PATENT DOCUMENTS 5,640,184 A * 6/1997 Moynihan ..... B41J 2/162 347/47
5,646,662 A * 7/1997 Kitahara ..... B41J 2/162 347/47
5,933,168 A 8/1999 Sakai
(Continued)

FOREIGN PATENT DOCUMENTS

JP H05-293960 A 11/1993
JP 2003112425 A * 4/2003
(Continued)

*Primary Examiner* — Shelby L Fidler
(74) *Attorney, Agent, or Firm* — Chip Law Group

(57) ABSTRACT

A liquid-discharging-head includes a nozzle having a first-nozzle-portion having a first-sectional-area and a second-nozzle-portion having a second-sectional-area larger than the first-sectional-area, a liquid chamber which communicates with the nozzle, and a piezoelectric-element which changes a pressure inside the liquid chamber, in which the piezoelectric-element is driven from the control section, and the liquid-discharging-head executes a first control in which an apex of a liquid surface is drawn into the second-nozzle-portion in a state in which an inner wall surface of the first-nozzle-portion is covered by a liquid film by decreasing the pressure inside the liquid chamber, and a second control in which a shape of the apex of the liquid surface is inverted to a protruding shape towed the opening and the droplet is discharged from the nozzle by increasing the pressure inside the liquid chamber in a state in which the inner wall surface is covered by the liquid film.

3 Claims, 13 Drawing Sheets

(56) References Cited

U.S. PATENT DOCUMENTS

| | | | | |
|---|---|---|---|---|
| 2008/0018678 | A1* | 1/2008 | Shimura | B41J 2/14274 347/9 |
| 2010/0110128 | A1 | 5/2010 | Ozawa | |
| 2011/0050804 | A1* | 3/2011 | Otokita | B41J 2/162 347/47 |
| 2013/0050343 | A1 | 2/2013 | Ozawa | |

FOREIGN PATENT DOCUMENTS

| | | | | |
|---|---|---|---|---|
| JP | 2003-211669 | A | | 7/2003 |
| JP | 2005088229 | A | * | 4/2005 |
| JP | 2005305883 | A | * | 11/2005 |
| JP | 2008-246785 | A | | 10/2008 |
| JP | 2010-110968 | A | | 5/2010 |
| JP | 2011194857 | A | * | 10/2011 |
| JP | 2013-043381 | A | | 3/2013 |

* cited by examiner

LIQUID DISCHARGING HEAD AND LIQUID DISCHARGING APPARATUS

The present application is based on, and claims priority from JP Application Serial Number 2018-244292, filed Dec. 27, 2018, the disclosure of which is hereby incorporated by reference herein in its entirety.

BACKGROUND

1. Technical Field

The present disclosure relates to a liquid discharging head and a liquid discharging apparatus provided with the liquid discharging head.

2. Related Art

Various considerations are carried out in order to apply ink jet technology to electrode formation, direct formation of various electrical components, formation of light-emitting bodies and filters used in displays, formation of micro-lenses, and the like. The kinds of liquid discharged from a nozzle are diversified according to an expansion in the uses of the ink jet technology.

For example, the liquid discharging apparatus described in JP-A-2010-110968 is provided with a pressure chamber communicated with each of a liquid supplying section and a nozzle, and a nozzle having a first portion defined as having a smaller opening area on a discharging side of a liquid than on the pressure chamber side of the liquid and a second portion communicating with the discharge-side end portion of the first portion, in which a meniscus positioned at the second portion is drawn in to the first portion and the liquid is pressurized before returning to the second portion to efficiently use the pressure applied to the liquid in the discharging of the liquid and to efficiently discharge a high-viscosity liquid.

As a result of intensive studies, the inventor of the present application has found that when the viscosity of the liquid increases, the frictional resistance between the inner wall surface of the nozzle and the liquid to be discharged increases in proportion to the viscosity and loss due to friction and the like increases with respect to the energy of the liquid necessary for the discharging. Therefore, a straight portion of the nozzle is lengthened and the meniscus is greatly drawn in to form a liquid film inside the nozzle and the energy loss at the boundary between the inner wall surface of the nozzle and the liquid. However, since the straight portion of the nozzle is lengthened, the flow path resistance increases and it is difficult to pressurize the liquid inside the nozzle using little energy.

Therefore, there is a demand for further improvement to the liquid discharging apparatus described in JP-A-2010-110968 with relation to efficiently discharging a high-viscosity liquid.

SUMMARY

According to an aspect of the disclosure, there is provided a liquid discharging head mounted on a liquid discharging apparatus that is provided with a control section which performs discharge control on a liquid as a droplet, the liquid discharging head including a first nozzle portion which discharges the liquid from a distal end and has a first sectional area, a second nozzle portion which communicates with the first nozzle portion and has a second sectional area larger than the first sectional area, a liquid chamber which communicates with the second nozzle portion, and a pressure changing section which changes a pressure of the liquid inside the liquid chamber, in which the pressure changing section is driven based on a drive signal from the control section, and the liquid discharging head executes a first control in which a center portion of a liquid surface of the liquid is drawn into the second nozzle portion in a state in which an inner wall surface of the first nozzle portion is covered by a liquid film of the liquid by lowering the pressure of the liquid inside the liquid chamber, and a second control in which a shape of the center portion of the liquid surface is inverted to a protruding shape facing the distal end side and the liquid is further discharged from the center portion of the liquid surface having a protruding shape by raising the pressure of the liquid inside the liquid chamber in a state in which the inner wall surface is covered by the liquid film.

In the liquid discharging head of the present application, a nozzle length of the first nozzle portion may be greater than or equal to twice a diameter of the first nozzle portion.

In the liquid discharging head of the present application, it is preferable that after inverting a shape of the center portion of the liquid surface to a protruding shape facing the distal end side, a flow velocity of an apex on the liquid chamber side of the liquid surface of the liquid become the maximum at a region of the second nozzle portion.

It is preferable that the liquid discharging head of the present application further include a nozzle connection portion having a tapered shape between the first nozzle portion and the second nozzle portion.

The liquid discharging head may further include a third nozzle portion positioned closer to the liquid chamber side than the second nozzle portion and having a third sectional area larger than the second sectional area, in which in the first control, the center portion of the liquid surface may be drawn into the third nozzle portion.

A liquid discharging apparatus of the present application includes a transport mechanism which transports a recording medium, the liquid discharging head which discharges a liquid onto the recording medium as a droplet, and a control section which performs drive control on the liquid discharging head.

DESCRIPTION OF EXEMPLARY EMBODIMENTS

Figure 1:
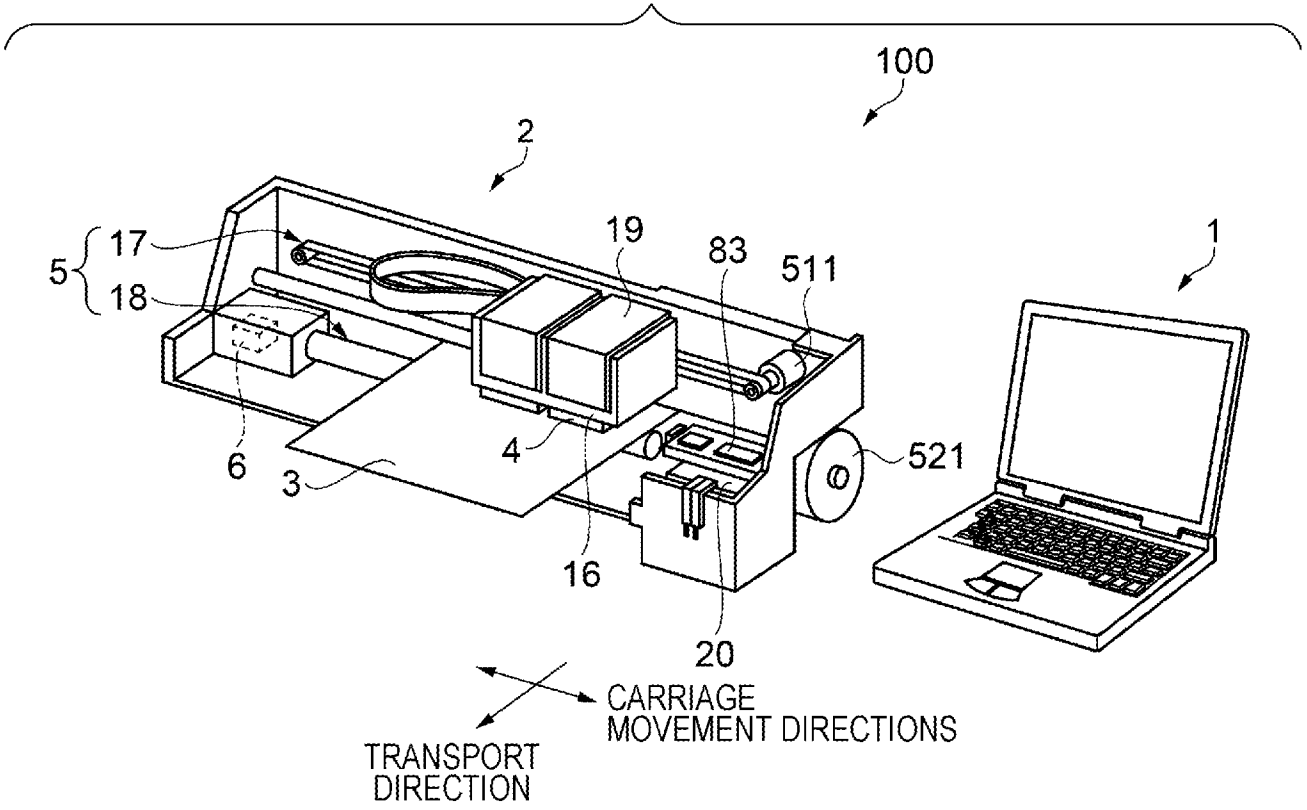
FIG. 1 is a schematic diagram illustrating an outline configuration of a printing system.

Hereinafter, the embodiments of the invention will be described with reference to the drawings. The embodiments illustrate modes of the present disclosure, are not intended to limit the present disclosure, and may be arbitrarily modified within a scope of the technical idea of the present disclosure. In the drawings used in the following description, the scale of each layer and each part is depicted differently from actuality to render each layer and each part a visually recognizable size.

First Embodiment

Printing System

Figure 2:
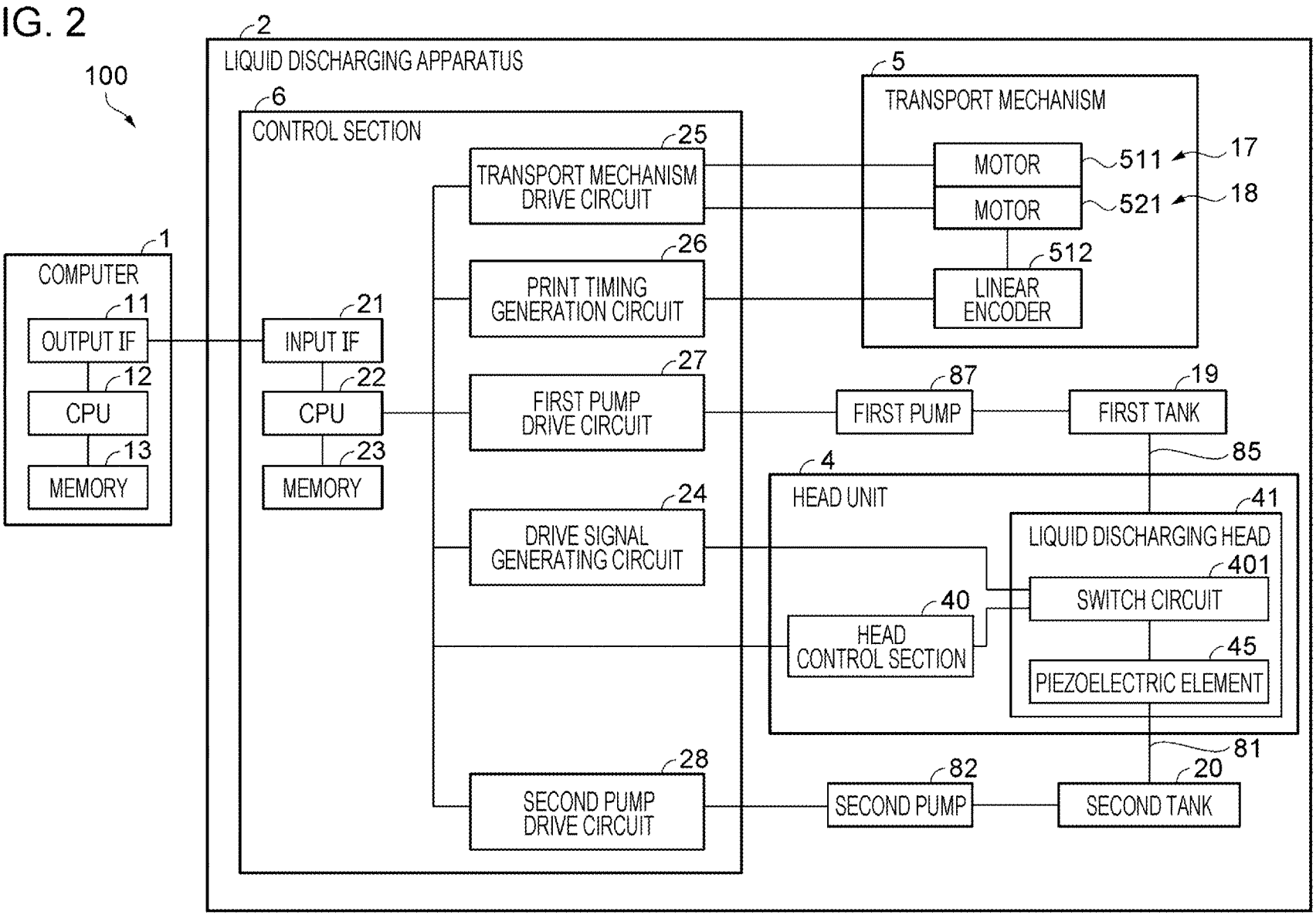
FIG. 2 is a block diagram illustrating a schematic configuration of the printing system.
Figure 3:
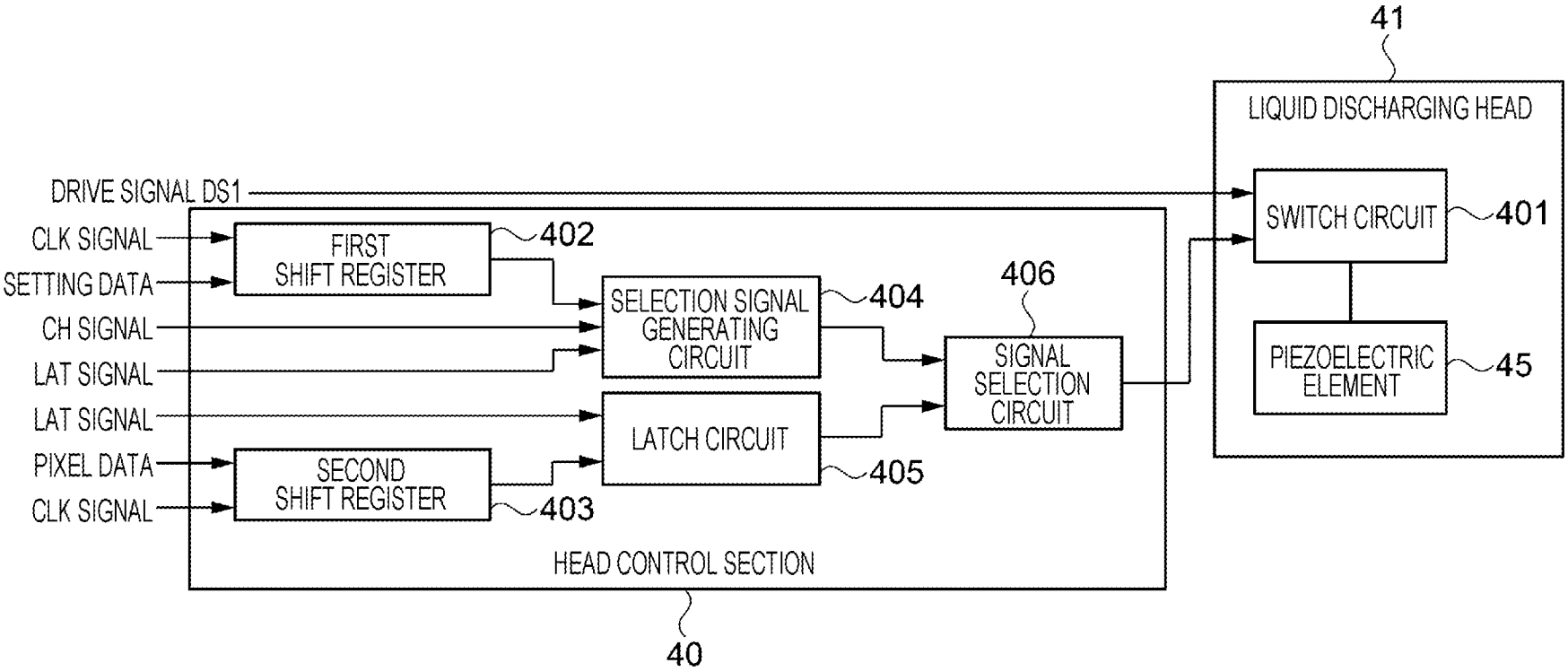
FIG. 3 is a block diagram describing the schematic configuration of a head control section.

FIG. 1 is a schematic diagram illustrating an outline configuration of a printing system 100. FIG. 2 is a block diagram illustrating a schematic configuration of the printing system 100. FIG. 3 is a block diagram describing the schematic configuration of a head control section 40.

First, a description will be given of the outline of the printing system 100 with reference to FIGS. 1 and 2.

As illustrated in FIGS. 1 and 2, the printing system 100 includes a computer 1 and a printer 2 which is an example of a liquid discharging apparatus in the present disclosure. The computer 1 is communicably connected with the printer 2 and outputs print data to the printer 2. The printer 2 prints an image onto a recording medium 3 such as paper, fabric, or film based on the print data output from the computer 1.

The printer 2 includes a head unit 4 (a liquid discharging head 41), a transport mechanism 5, a control section 6, a first tank 19, a second tank 20, and a carriage 16. In other words, the printer 2 includes the transport mechanism 5 which transports the recording medium 3, the liquid discharging head 41 which discharges a liquid 7 onto the recording medium 3 as a droplet 10*a*, and the control section 6 which performs the drive control of the liquid discharging head 41.

The head unit 4 includes the head control section 40 and the liquid discharging head 41. The liquid discharging head 41 is provided on a surface facing the recording medium 3 of the carriage 16 and discharges the liquid 7 onto the recording medium 3. The head control section 40 is provided in the inner portion of the carriage 16 and is electrically coupled to the control section 6.

The liquid 7 may be a material which is in a liquid phase state and the liquid 7 also encompasses liquid state materials such as sol and gel. The liquid 7 not only encompasses liquids as a state of a material but also encompasses solutions, disperses and mixtures in which particles of functional material formed from solids such as pigments or metal particulate are dissolved, dispersed or mixed into a solvent. Examples of the liquid 7 include an ink, a liquid crystal emulsifier, and a metal paste.

The transport mechanism 5 includes a carriage movement mechanism 17 and a recording medium transport mechanism 18. The carriage movement mechanism 17 drives a motor 511 and moves the carriage 16 provided with the head unit 4 in carriage movement directions. The printer 2 prints an image onto the recording medium 3 due to the carriage 16 performing a reciprocating motion in the carriage movement directions and the liquid discharging head 41 discharging the liquid 7 based on the print data. The recording medium transport mechanism 18 transports the recording medium 3 in a transport direction using a motor 521. The transport direction is a direction intersecting the carriage movement directions.

The first tank 19 stores the liquid 7 supplied to the liquid discharging head 41 through an inflow path 85 and includes a first pump 87. The first pump 87 pressurizes the liquid 7 flowing through the inflow path 85 by pressurizing the inside of the first tank 19. The liquid 7 supplied to the liquid discharging head 41 is discharged onto the recording medium 3 by driving a piezoelectric element 45 inside the liquid discharging head 41.

The piezoelectric element 45 is an example of a pressure changing section in the present application.

The second tank 20 stores the liquid 7 that is not discharged onto the recording medium 3 from the liquid discharging head 41 through an elimination path 81 and includes a second pump 82. The second pump 82 suctions the liquid 7 from the liquid discharging head 41 through the elimination path 81 by reducing the pressure inside the second tank 20. It is acceptable to omit either the first pump 87 or the second pump 82.

The elimination path 81 includes a cap 83 which comes into contact with the liquid discharging head 41. The second pump 82 reduces the pressure inside the cap 83 via the second tank 20 and suctions the thickened liquid 7 from the liquid discharging head 41. Accordingly, it is possible to suppress the accumulation of a precipitating component in the liquid.

Next, a simple description will be given of the configuration of the computer 1.

The computer 1 includes an output interface 11 (output IF), a CPU 12, and a memory 13.

The output interface 11 carries out the transferring of data with the printer 2. The CPU 12 is an operational processing device for performing the overall control of the computer 1. The memory 13 is configured by a RAM, an EEPROM, a ROM, a magnetic disc device, or the like and stores computer programs to be used by the CPU 12. The computer programs stored in the memory 13 are an application program, a printer driver, and the like. The CPU 12 performs various control according to the computer program.

Next, a simple description will be given of the configuration of the control section 6 of the printer 2.

The control section 6 includes an input interface 21 (input IF), a CPU 22, a memory 23, a drive signal generating circuit 24, a transport mechanism drive circuit 25, a print timing generating circuit 26, a first pump drive circuit 27, and a second pump drive circuit 28.

The input interface 21 carries out the transferring of data with the computer 1 which is an external device. The CPU 22 is an operational processing device for performing the overall control of the printer 2. The memory 23 is configured by a RAM, an EEPROM, a ROM, a magnetic disc device, or the like and stores computer programs to be used by the CPU 22. The CPU 22 performs various control according to the computer program stored in the memory 23.

The drive signal generating circuit 24 generates a drive signal DS1 (refer to FIG. 6) when a clock signal is inputted to the drive signal generating circuit 24. The drive signal generating circuit 24 periodically generates the drive signal DS1 and outputs the drive signal DS1 to a switch circuit 401.

The transport mechanism drive circuit 25 controls the transporting amount of the transport mechanism 5 via motors 511 and 521. For example, the transport mechanism drive circuit 25 causes the motor 511 of the carriage movement mechanism 17 to rotate and transports the carriage 16 in the carriage movement directions. At this time, a linear encoder 512 attached to the motor 511 calculates the transporting amount of the carriage 16 from the rotation amount of the motor 511 and outputs the transporting amount to the print timing generating circuit 26. The print timing generating circuit 26 generates a clock signal based on the transporting amount and outputs the clock signal to the head control section 40 and the transport mechanism drive circuit 25.

The first pump drive circuit 27 drives the first pump 87 and controls the pressure of the first tank 19. Similarly, the second pump drive circuit 28 drives the second pump 82 and controls the pressure of the second tank 20. The second pump 82 reduces the pressure inside the second tank 20 during the cleaning of the liquid discharging head 41 and suctions the thickened liquid from the liquid discharging head 41.

Next, a simple description will be given of the configuration of the head control section 40.

As illustrated in FIG. 3, the head control section 40 includes a first shift register 402, a second shift register 403, a selection signal generating circuit 404, a latch circuit 405, and a signal selection circuit 406.

The clock signal (the CLK signal), a latch signal (a LAT signal), a change signal (a CH signal), and a setting signal are input to the head control section 40 from the control section 6. The setting signal contains pixel data and setting data.

When the setting signal is inputted to the head control section 40 in synchronization with the clock signal, the setting data is set in the first shift register 402 and the pixel data is set in the second shift register 403. The setting data is latched to the selection signal generating circuit 404 and the pixel data is latched to the latch circuit 405 according to a pulse of the latch signal.

The selection signal generating circuit 404 generates a plurality of selection signals based on the setting data and the change signal. The signal selection circuit 406 selects one of the plurality of selection signals input by the selection signal generating circuit 404 according to the pixel data latched to the latch circuit 405. The selected selection signal is output from the signal selection circuit 406 as a switch signal.

The drive signal DS1 and the switch signal are input to the switch circuit 401. When the switch signal is at an H level, the switch circuit 401 assumes an ON state and the drive signal DS1 is supplied to the piezoelectric element 45. When the switch signal is at an L level, the switch circuit 401 assumes an OFF state and the drive signal DS1 is not supplied to the piezoelectric element 45.

According to this configuration, the control section 6 controls the piezoelectric element 45 and the liquid discharging head 41 discharges the liquid 7 onto the recording medium 3 based on the drive signal DS1 supplied from the control section 6.

Liquid Discharging Head

Figure 4:
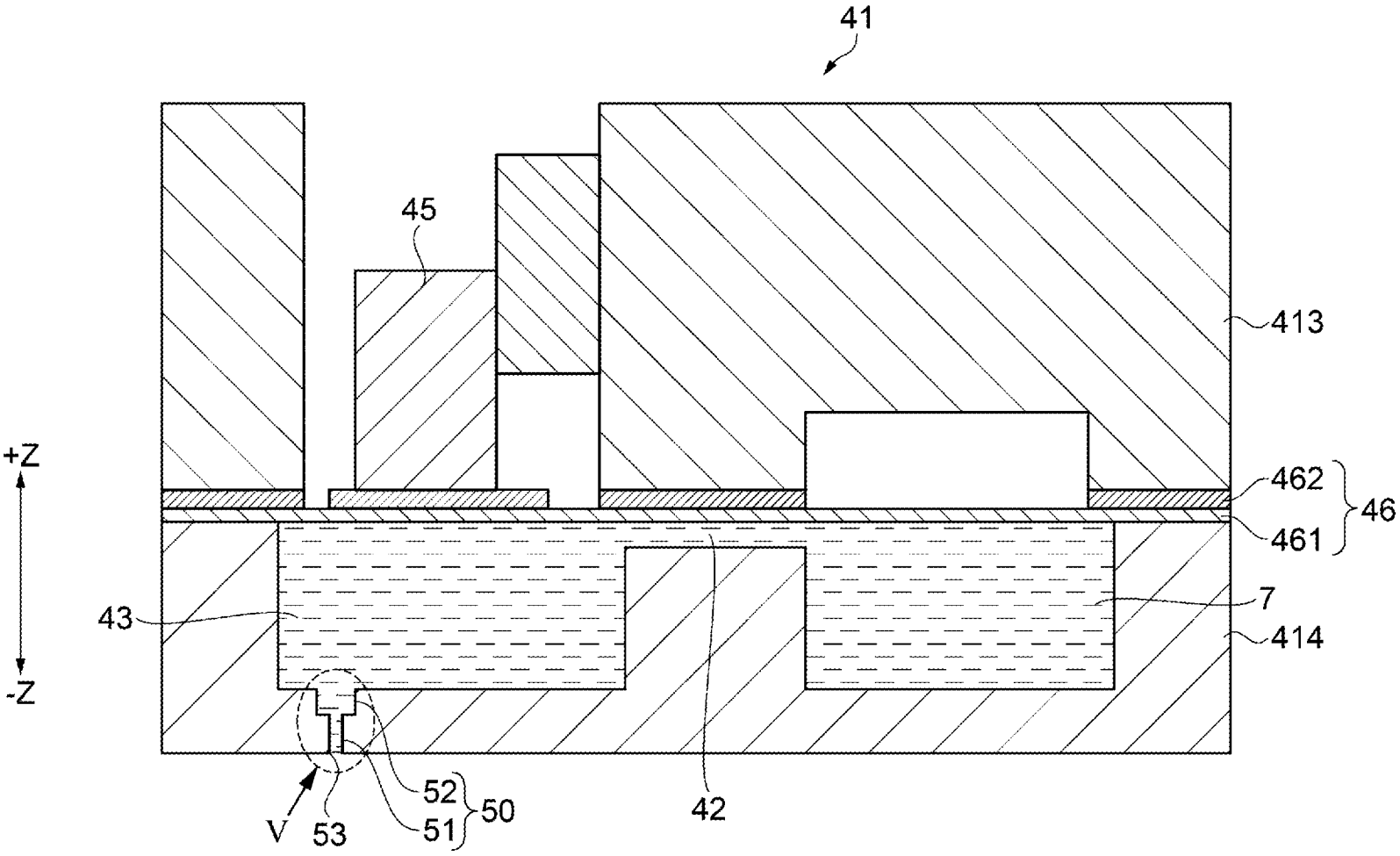
FIG. 4 is a schematic diagram illustrating a configuration of a liquid discharging head according to a first embodiment.
Figure 5:
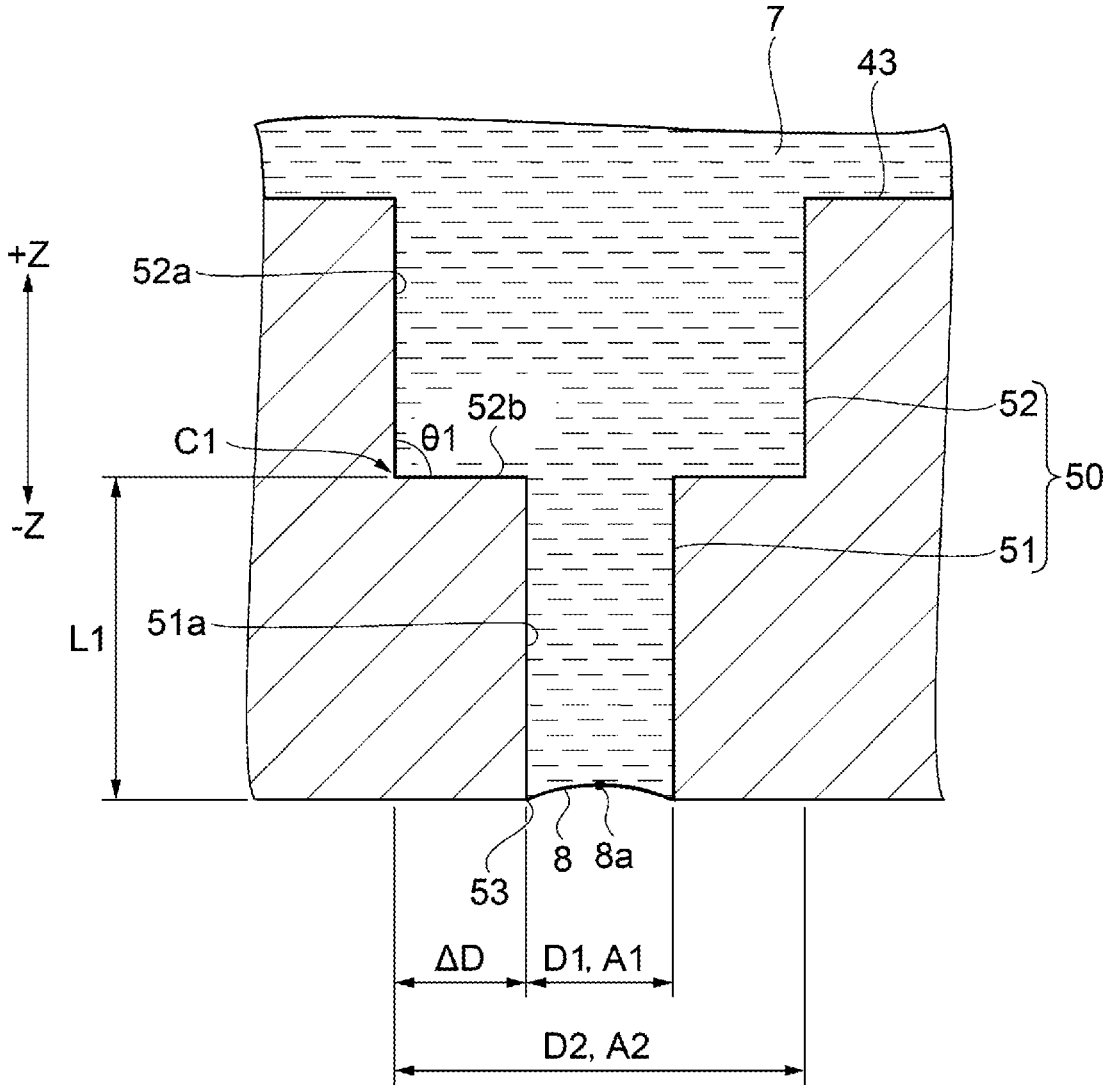
FIG. 5 is an enlarged view of a region surrounded by a dashed line in FIG. 4.

FIG. 4 is a schematic diagram illustrating the configuration of the liquid discharging head 41 according to the present embodiment. FIG. 5 is an enlarged view of a region V surrounded by a dashed line in FIG. 4. FIGS. 4 and 5 illustrate a stable state in which a pressure change is not being generated in the liquid 7 inside a liquid chamber 43.

Next, a description will be given of an outline of the liquid discharging head 41 according to the present embodiment with reference to FIGS. 4 and 5.

As illustrated in FIG. 4, the liquid discharging head 41 includes a nozzle plate 55 in which a nozzle portion 50 is provided. The nozzle portion 50 includes a first nozzle portion 51 which discharges the liquid 7 onto the recording medium 3 as the droplet 10*a* and a second nozzle portion 52 which communicates with the first nozzle portion 51. The first nozzle portion 51 includes an opening 53 which discharges the liquid 7 on the −Z-direction side as the droplet 10*a*.

The opening 53 is an example of a distal end in the present application.

The liquid discharging head 41 is provided with the first nozzle portion 51 which discharges the liquid 7 from the opening 53 onto the recording medium 3, the second nozzle portion 52 which communicates with the first nozzle portion 51, the liquid chamber 43 which communicates with the second nozzle portion 52, and the piezoelectric element 45 which changes the pressure of the liquid 7 inside the liquid chamber 43. The piezoelectric element 45 is fixed to a fixing plate 413. The piezoelectric element 45 is driven based on the drive signal DS1 via flexible wiring (not illustrated) from the control section 6.

In the following description, a direction heading from the opening 53 toward the liquid chamber 43 will be referred to as a +Z-direction and a direction heading from the liquid chamber 43 toward the opening 53 will be referred to as a −Z-direction.

The liquid chamber 43 is a space configured by forming a recessed portion in a flow path forming substrate 414 and sealing the opening of the recessed portion using a diaphragm 46. The liquid chamber 43 communicates with a supply flow path 42 for supplying the liquid 7 and the second nozzle portion 52. The supply flow path 42 is connected to the first tank 19 via a common flow path (not illustrated).

The diaphragm 46 is formed by a laminate body of a thin portion 461 and a thick portion 462 and configures a portion of the wall surface of the liquid chamber 43. The thin portion 461 has elasticity and is capable of deforming in the +Z-direction or the −Z-direction. The thick portion 462 is fixed to the piezoelectric element 45 and is capable of expanding the volume change by having a larger area than the piezoelectric element 45. When the diaphragm 46 deforms in the +Z-direction, the volume of the liquid chamber 43 increases and when the diaphragm 46 deforms in the −Z-direction, the volume of the liquid chamber 43 decreases.

The fixing plate 413 is a case which stores the piezoelectric element 45, has rigidity, and is fixed to the diaphragm 46.

In the piezoelectric element 45, one end portion in expanding and contracting directions of the piezoelectric element 45 is fixed to the fixing plate 413 and the other end portion in the extending and contracting directions of the piezoelectric element 45 is fixed to the diaphragm 46. When the piezoelectric element 45 extends or contracts using one of the end portions as a fulcrum based on the drive signal DS1 supplied from the control section 6, the position of the other end portion fixed to the diaphragm 46 changes and the diaphragm 46 deforms in the +Z-direction or the −Z-direction.

The piezoelectric element 45 is a longitudinal vibration mode piezoelectric actuator which contracts when charged and expands when discharged. When the piezoelectric element 45 expands, the diaphragm 46 deforms in the −Z-direction, the liquid chamber 43 contracts, and the pressure of the liquid 7 inside the liquid chamber 43 rises. When the piezoelectric element 45 contracts, the diaphragm 46 deforms in the +Z-direction, the liquid chamber 43 expands, and the pressure of the liquid 7 inside the liquid chamber 43 drops.

The piezoelectric element 45 may be a flexural vibration mode piezoelectric actuator.

As illustrated in FIG. 5, the nozzle portion 50 includes the first nozzle portion 51 disposed on the −Z-direction side and the second nozzle portion 52 disposed on the +Z-direction side. The first nozzle portion 51 includes the opening 53 positioned on the −Z-direction end and an inner wall surface 51*a*. The second nozzle portion 52 includes a base surface 52*b* and an inner wall surface 52*a*.

In a stable state in which a pressure change is not generated inside the liquid chamber 43, an outer circumferential edge of a liquid surface 8 (a meniscus) of the liquid 7 is positioned at the opening 53 of the first nozzle portion 51 and an apex 8*a* of the liquid surface 8 of the liquid 7 is positioned on the liquid chamber 43 side with respect to the opening 53 of the first nozzle portion 51 due to the surface tension. A black circle in the diagram is the apex 8*a* of the liquid surface 8 of the liquid 7.

When viewed from the +Z-direction, the cross-sections of the first nozzle portion 51 and the second nozzle portion 52 are substantially circular, the diameter of the second nozzle portion 52 is D2, a second sectional area of the second nozzle portion 52 is A2, a diameter of the first nozzle portion 51 is D1, and a first sectional area of the first nozzle portion 51 is A1. The diameter D2 of the second nozzle portion 52 is longer than the diameter D1 of the first nozzle portion 51, the second sectional area A2 of the second nozzle portion 52 is greater than the first sectional area A1 of the first nozzle portion 51, and the second nozzle portion 52 is thicker than the first nozzle portion 51.

In other words, the nozzle portion 50 includes the first nozzle portion 51 having the first sectional area A1 and the second nozzle portion 52 which communicates with the first nozzle portion 51 and has the second sectional area A2 which is larger than the first sectional area A1.

The nozzle length (the length in the Z-directions) of the first nozzle portion 51 is L1 and is longer than the diameter D1 of the first nozzle portion 51. In the present embodiment, the nozzle length L1 of the first nozzle portion 51 is set to be greater than or equal to twice the diameter D1 of the first nozzle portion 51.

A dimension of the base surface 52*b* in the second nozzle portion 52 (the length in a direction intersecting the Z-directions) is ΔD. In the present embodiment, the dimension ΔD of the base surface 52*b* in the second nozzle portion 52 is set to approximately 5 μm. In the second nozzle portion 52, an angle θ1 of a corner portion C1 formed by the inner wall surface 52*a* and the base surface 52*b* is a right angle (90°).

Figure 6:
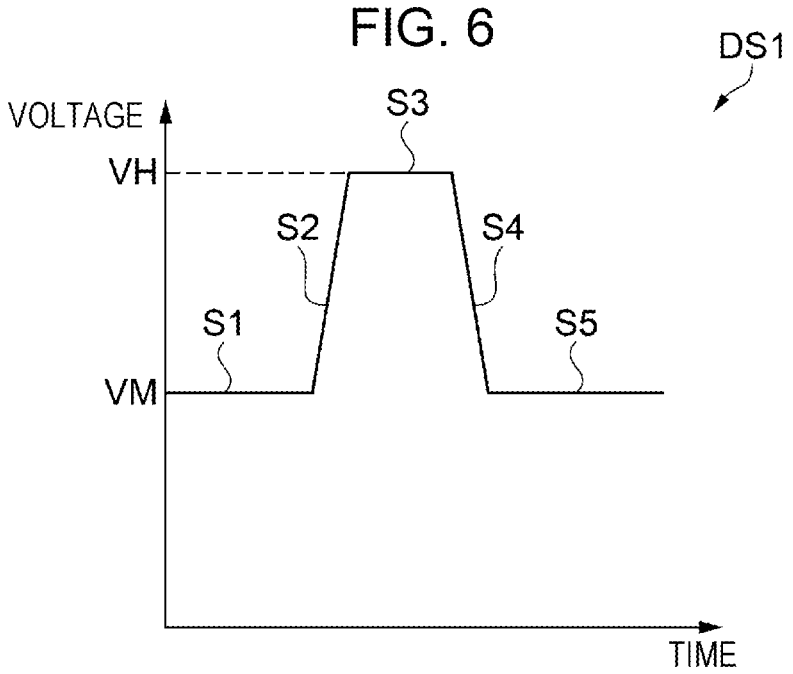
FIG. 6 is a schematic diagram illustrating a state of a drive signal supplied from a control section to a piezoelectric element.
Figure 7:
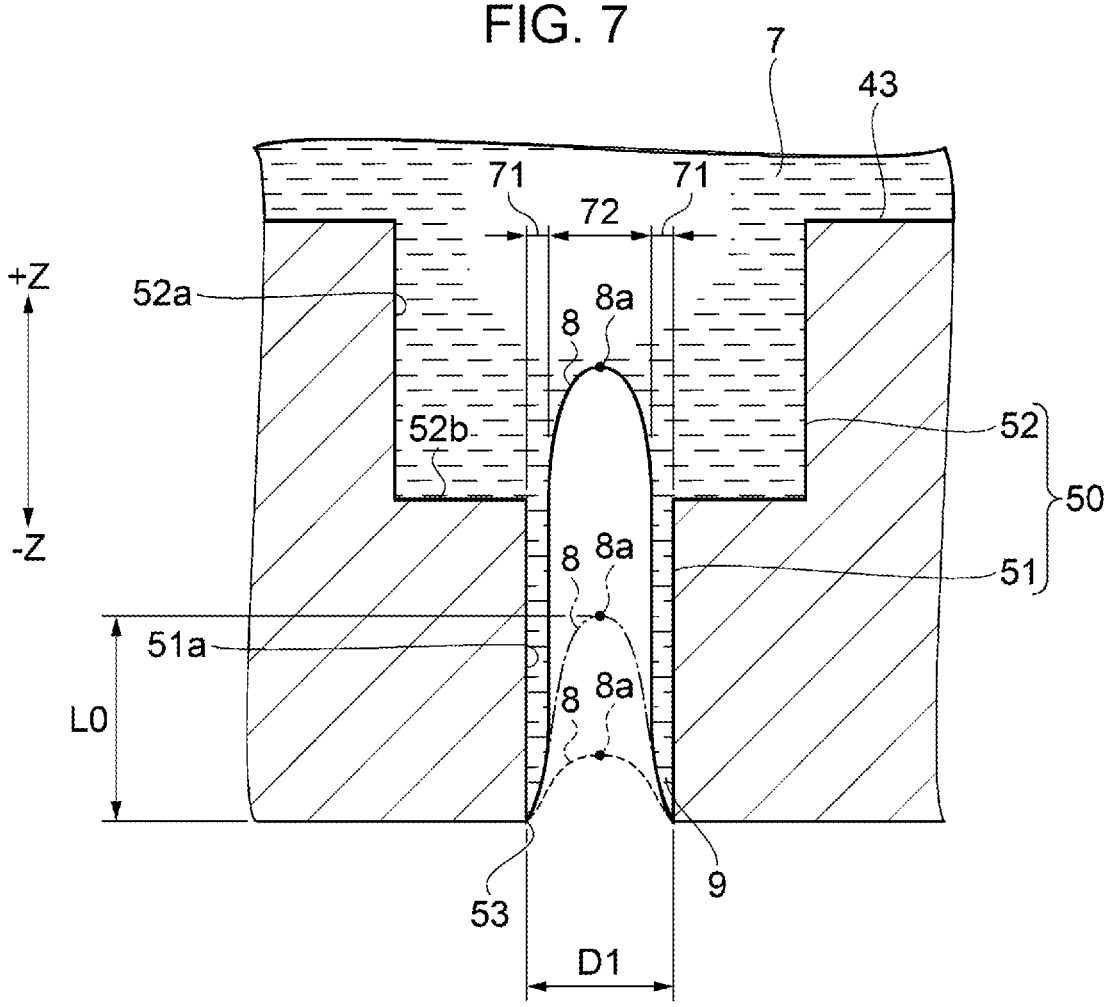
FIG. 7 is a schematic diagram illustrating a state of a liquid surface when preparation signals are supplied from the control section to the piezoelectric element.
Figure 8:
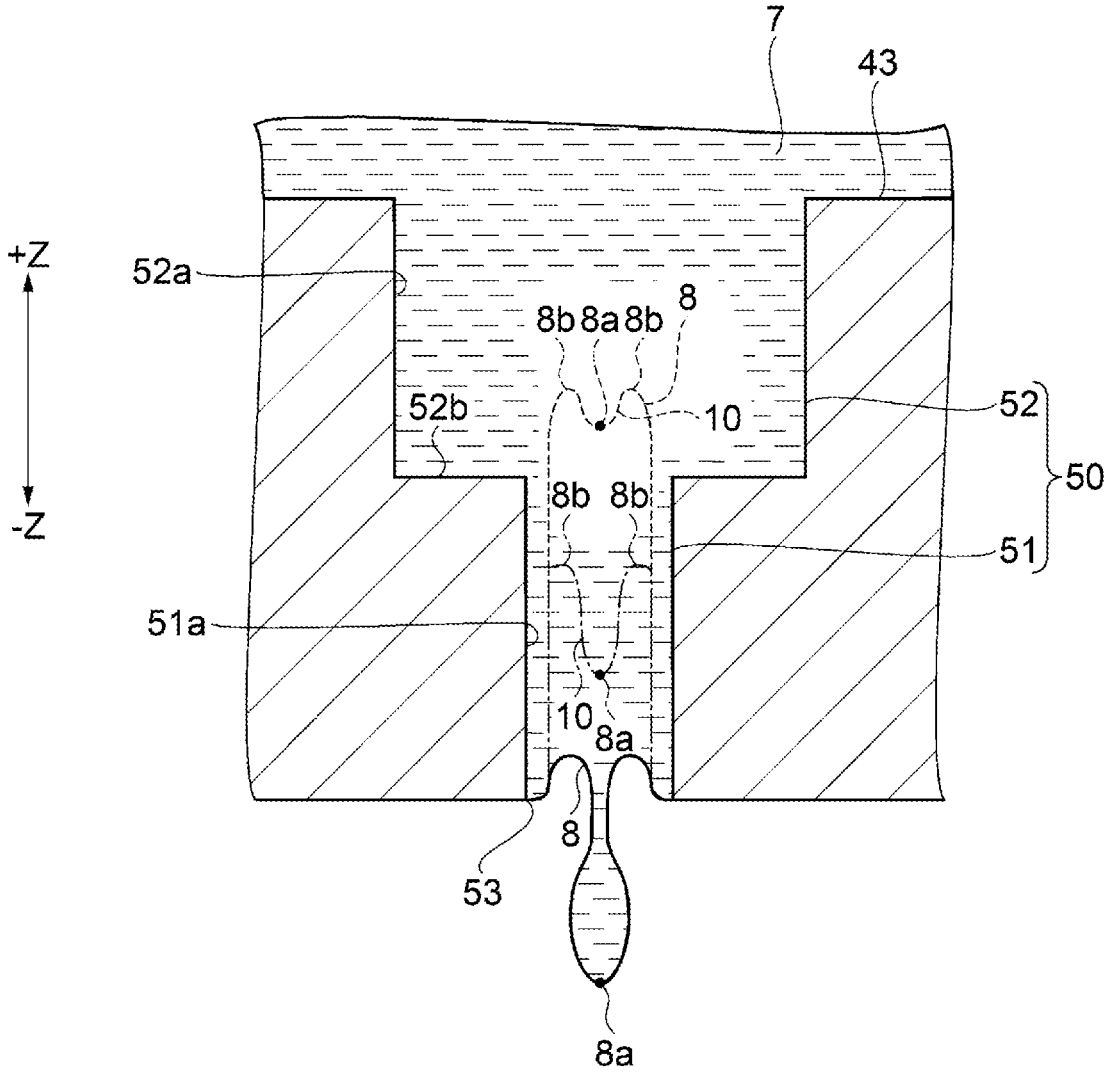
FIG. 8 is a schematic diagram illustrating a state of the liquid surface when the discharge signal is supplied from the control section to the piezoelectric element.
Figure 9:
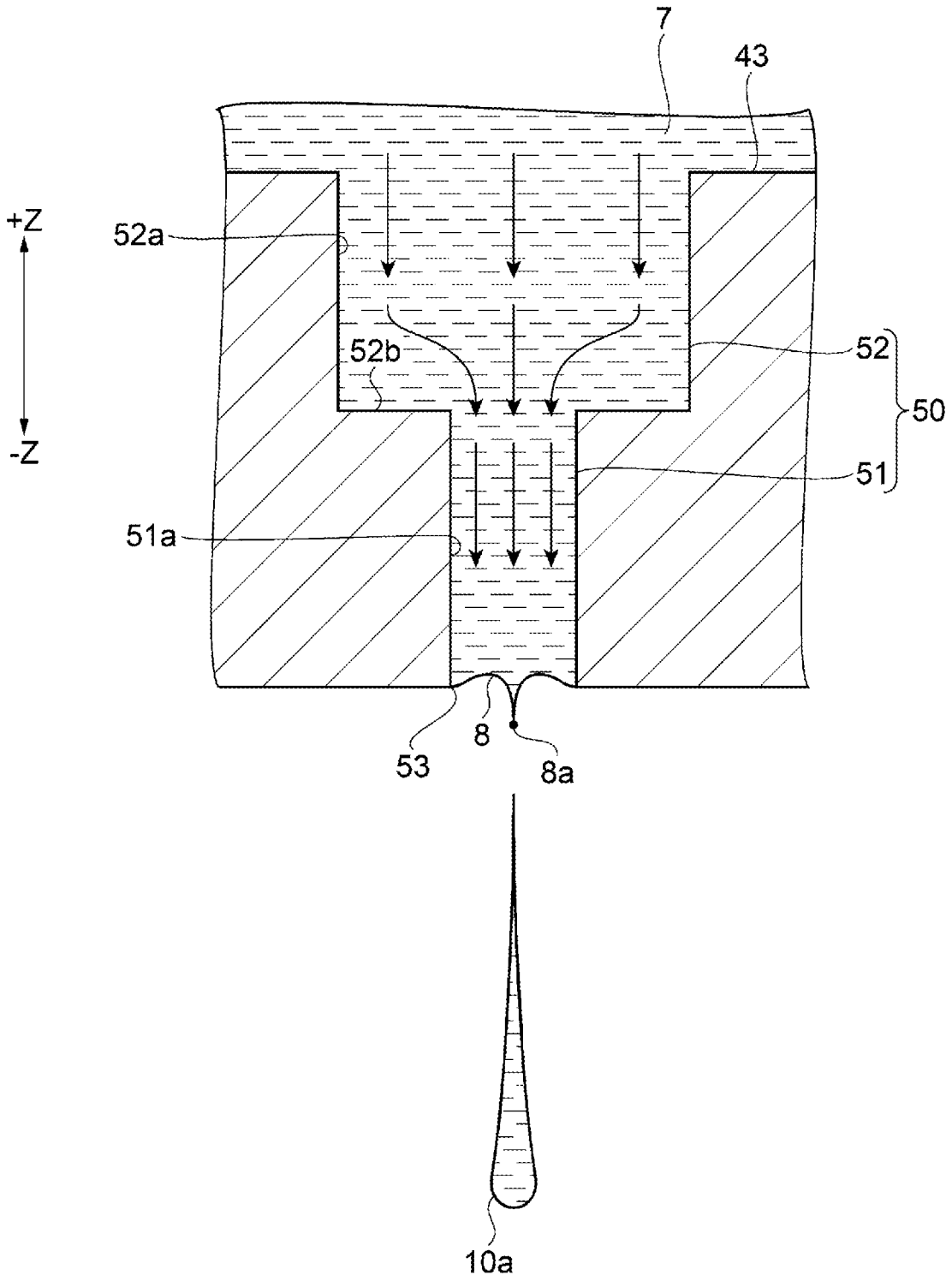
FIG. 9 is a schematic diagram illustrating a state of the liquid surface when the discharge signal is supplied from the control section to the piezoelectric element.

FIG. 6 is a schematic diagram illustrating the state of the drive signal DS1 supplied from the control section 6 to the piezoelectric element 45. FIGS. 7 to 9 are diagrams corresponding to FIG. 5 and are schematic diagrams illustrating states of the liquid surface 8 which changes according to the drive signal DS1 supplied from the control section 6 to the piezoelectric element 45. In detail, FIG. 7 is a schematic diagram illustrating the state of the liquid surface 8 when preparation signals S2 and S3 are supplied from the control section 6 to the piezoelectric element 45. FIGS. 8 and 9 are schematic diagrams illustrating the states of the liquid surface 8 when a discharge signal S4 is supplied from the control section 6 to the piezoelectric element 45.

As illustrated in FIG. 6, the drive signal DS1 supplied from the control section 6 to the piezoelectric element 45 contains a signal S1 which is a starting point of the drive signal DS1, the preparation signals S2 and S3, the discharge signal S4, and a signal S5 which is an end point of the drive signal DS1.

The signal S1 and the signal S5 are set to a reference drive voltage VM. The preparation signals S2 and S3 are signals for raising the voltage from the reference drive voltage VM to a highest drive voltage VH and causing the liquid chamber 43 to expand to draw in the liquid surface 8 of the liquid 7 to the liquid chamber 43 side. The discharge signal S4 is a signal for lowering the voltage from the highest drive voltage VH to the reference drive voltage VM and causing the liquid chamber 43 to contract to discharge the liquid 7 as the droplet 10*a*.

The process (the control) carried out due to the piezoelectric element 45 being driven based on the preparation signals S2 and S3 supplied from the control section 6 is a first control. The process (the control) carried out due to the piezoelectric element 45 being driven based on the discharge signal S4 supplied from the control section 6 is a second control.

When the signal S1 (the reference drive voltage VM) is supplied from the control section 6 to the piezoelectric element 45, neither expansion or contraction occurs in the piezoelectric element 45 and the liquid discharging head 41 assumes a stable state in which a pressure change is not generated in the liquid 7 in the liquid chamber 43. In the stable state, the outer circumferential edge of the liquid surface 8 of the liquid 7 is positioned at the opening 53 of the first nozzle portion 51 and the apex 8*a* of the liquid surface 8 is positioned on the liquid chamber 43 side with respect to the opening 53 of the first nozzle portion 51 (refer to FIG. 5).

When the preparation signal S2 is supplied to the piezoelectric element 45, the piezoelectric element 45 contracts, the diaphragm 46 deforms in the +Z-direction, the liquid chamber 43 expands, the pressure of the liquid 7 in the liquid chamber 43 drops, and the liquid 7 inside the first nozzle portion 51 is drawn into the liquid chamber 43 side. In the present embodiment, as depicted using a solid line in FIG. 7, the liquid 7 inside the nozzle portion 50 is drawn into the liquid chamber 43 side until the apex 8*a* of the liquid surface 8 is disposed inside the second nozzle portion 52.

In an initial first stage at which the preparation signal S2 starts being supplied to the piezoelectric element 45, a spherical arc-shaped meniscus (the liquid surface 8) having the edge of the opening 53 of the first nozzle portion 51 as an origin is formed as depicted by the dashed line of FIG. 7.

At a second stage at which the preparation signal S2 is supplied to the piezoelectric element 45, the meniscus (the liquid surface 8) is drawn into the liquid chamber 43 side as depicted by a dot-dash line of FIG. 7. At this time, the curvature radius of the center of the meniscus gradually decreases and the meniscus (the liquid surface 8) is formed in a parabolic shape.

At a third stage at which the preparation signal S2 continues to be supplied to the piezoelectric element 45, a liquid film 9 to which the liquid 7 adheres at a substantially fixed thickness is formed on the inner wall surface 51*a* of the first nozzle portion 51 and the meniscus (the liquid surface 8) retreats to the back of the nozzle portion 50 while maintaining this shape in a state in which the curvature radius of the center of the meniscus does not substantially change. In other words, in the third stage, since a region 71 in which the liquid 7 remains on the nozzle wall surface and a region 72 in which the liquid 7 flows in the +Z-direction are present even if the liquid chamber 43 expands, a void is formed in the inside of the liquid film 9 and a meniscus (the liquid surface 8) such as the one depicted by a solid line in FIG. 7 is formed on an end portion of the +Z-direction side of the void. When the preparation signal S2 still continues to be supplied from the third stage, a fourth stage is reached in which the void portion reaches the second nozzle portion 52. At this time, the meniscus (the liquid surface 8) moves in the +Z-direction while the shape of the meniscus (the liquid surface 8) remains substantially the same as that of the third stage.

Hereinafter, a detailed description will be given of the movement with respect to the first through fourth stages. The first through third stages are not clearly demarcated and gradually and continually transition to the next state.

First, in the initial stage (the first stage), due to a pressure reduction caused by the expansion of the liquid chamber 43, the liquid 7 is drawn into the inside in a spherical arc shape using the end portion of the meniscus (the liquid surface 8) as a fulcrum at the circumferential edge portion of the opening 53 which is the exit of the nozzle portion 50. The spherical arc-shaped meniscus (the liquid surface 8) is formed while the arc shape gradually decreases in size from a large curvature radius. Although dependent on the physical properties of the liquid 7 and the speed of the drawing in of the liquid 7, the first stage ends approximately when the meniscus (the liquid surface 8) reaches a length in the range of less than or equal to the diameter D1 of the first nozzle portion 51.

In the second stage, the shape of the meniscus (the liquid surface 8) becomes different from the spherical arc shape of the initial stage and the speed of the apex 8*a* of the meniscus (the liquid surface 8) assumes a parabolic velocity distribution that is faster than at the circumferential edge portion of the opening 53. Accordingly, the shape of the meniscus (the liquid surface 8) also has a parabolic void formed therein while the curvature radius of the apex 8*a* of the meniscus (the liquid surface 8) gradually decreases. The meniscus shape inside the nozzle portion 50 formed at this time is substantially maintained even in the subsequent continuation of the drawing in. The second stage continues approximately until the meniscus shape reaches a length of greater than or equal to twice the diameter D1 of the first nozzle portion 51. At this stage, the thickness of the liquid film 9 changes according to the Z-direction position.

In the third stage, the velocity distribution gradually becomes different from that of the second stage, and while maintaining the thickness of the liquid film 9 at a fixed level without the region of the liquid film 9 moving, the velocity distribution closer to the inside becomes substantially the same speed. Therefore, the meniscus (the liquid surface 8) moves in the +Z-direction without the curvature radius of the apex 8*a* of the meniscus (the liquid surface 8) changing and a columnar void portion is formed. It is generally known that the thickness of the liquid film 9 is based on Equation 1 where Reynold's number Re (a dimensionless number of a ratio between viscosity and momentum represented in Equation 3) falls within a small range of approximately less than or equal to 1000.

$$T = \frac{0.67Ca^{\frac{2}{3}}}{1 + 3.34Ca^{\frac{2}{3}}} D \tag{1}$$

Where T is the liquid film thickness, Ca is the capillary number (a dimensionless number of a ratio between surface tension and viscosity represented in Equation 2), and D is the nozzle diameter.

$$Ca = \frac{\mu v}{\sigma} \tag{2}$$

Where μ is the liquid viscosity of the liquid, v is a draw-in average speed, and σ is the surface tension of the liquid.

$$Re = \frac{\rho v D}{\mu} \tag{3}$$

Where ρ is the specific gravity of the liquid.

From the equations, it is possible to confirm a tendency for the liquid film 9 to become thicker in the direction in which the viscosity increases, the drawing in speed increases, or the surface tension decreases.

In the fourth stage, the meniscus (the liquid surface 8) retreats in the +Z-direction and reaches the second nozzle portion 52 due to the drawing in continuing further. The diameter D2 of the second nozzle portion 52 is wider than the diameter D1 of the first nozzle portion 51 by 2 μm to 10 μm and the dimension ΔD of the base surface 52*b* in the second nozzle portion 52 is set to approximately 1 μm to 5 μm, which is half of the difference between the diameters D1 and D2.

When the dimension ΔD of the base surface 52*b* is approximately 1 μm to 5 μm, as compared to a case in which the dimension ΔD of the base surface 52*b* is longer than approximately 5 μm, the influence of a frictional force applied from the inner wall surface 52*a* of the second nozzle portion 52 becomes stronger, and the liquid 7 flowing in the second nozzle portion 52 from the first nozzle portion 51 flows less easily in a direction heading from the apex 8*a* of the liquid surface 8 toward the inner wall surface 52*a* and flows more easily in the +Z-direction.

Therefore, when the liquid 7 flows in the +Z-direction inside the second nozzle portion 52, the void formed in the first nozzle portion 51 grows in the +Z-direction and a void of the same thickness as the void formed inside the first nozzle portion 51 is formed inside the second nozzle portion 52. In other words, when the dimension ΔD of the base surface 52*b* is approximately 1 μm to 5 μm, it is possible to form a void of the same thickness spanning from the first nozzle portion 51 to the second nozzle portion 52.

Meanwhile, when the dimension ΔD of the base surface 52*b* in the second nozzle portion 52 is excessively longer than approximately 5 μm, the influence of the frictional force applied from the inner wall surface 52*a* of the second nozzle portion 52 becomes weaker, and the liquid 7 flowing in the second nozzle portion 52 from the first nozzle portion 51 flows more easily in a direction heading from the apex 8*a* of the liquid surface 8 toward the inner wall surface 52*a* in addition to the +Z-direction in the second nozzle portion 52.

Therefore, when the liquid 7 flows in the +Z-direction inside the second nozzle portion 52, the void formed in the first nozzle portion 51 grows in a direction heading from the apex 8*a* of the liquid surface 8 toward the inner wall surface 52*a* in addition to the +Z-direction, and a void formed inside the second nozzle portion 52 becomes thicker than the void formed inside the first nozzle portion 51. In other words, when the dimension ΔD of the base surface 52*b* becomes excessively longer than approximately 5 μm, it becomes difficult to form a void of the same thickness spanning from the first nozzle portion 51 to the second nozzle portion 52.

Due to setting the nozzle length L1 of the first nozzle portion 51 to greater than or equal to twice the diameter D1 of the first nozzle portion 51 and setting the dimension ΔD of the base surface 52*b* to approximately 1 μm to 5 μm, it is possible to form a void of a uniform thickness spanning from the first nozzle portion 51 to the second nozzle portion 52.

It is possible to treat the void formed spanning from the first nozzle portion 51 to the second nozzle portion 52 as a pseudo-nozzle, and the void will be referred to as a pseudo-nozzle hereinafter.

Although details will be described in detail later, the discharge signal S4 is supplied to the piezoelectric element 45, the pressure of the liquid 7 inside the liquid chamber 43 is raised to push out the liquid 7 inside the nozzle portion 50 to the opening 53 side, and the liquid 7 is discharged from the pseudo-nozzle as the droplet 10*a* (refer to FIGS. 8 and 9).

When the nozzle length L1 of the first nozzle portion 51 becomes excessively longer than necessary, since the flow path resistance of the portion saturated by the liquid 7 to the meniscus when the liquid 7 flows increases and the energy dissipates as expected, the thickness of the liquid film 9 with respect to the liquid surface 8 becomes uniform and it is preferable for the nozzle length L1 of the first nozzle portion 51 to be short in a range in which the thickness of the pseudo-nozzle formed on the inside of the liquid film 9 is uniform.

Even if the dimension ΔD of the base surface 52*b* is shorter than 1 μm, it is possible to form the pseudo-nozzle of a uniform thickness spanning the first nozzle portion 51 and the second nozzle portion 52. However, when the dimension ΔD of the base surface 52*b* becomes too short, the second nozzle portion 52 becomes thin, the flow path resistance of the second nozzle portion 52 increases, and a harm of the energy dissipating occurs as expected. Since it is preferable for the flow path resistance of the second nozzle portion 52 to be small, it is preferable for the dimension ΔD of the base surface 52*b* to be long in a range in which it is possible to form the pseudo-nozzle spanning the first nozzle portion 51 and the second nozzle portion 52 at a uniform thickness.

According to the preparation signal S3, the state in which the piezoelectric element 45 is contracted is maintained and the pseudo-nozzle spanning from the first nozzle portion 51 to the second nozzle portion 52 is formed at a uniform thickness.

In this manner, in the present embodiment, the first control in which the apex 8*a* of the liquid surface 8 of the liquid 7 is drawn into the second nozzle portion 52 in a state in which the inner wall surface 51*a* of the first nozzle portion 51 is covered by the liquid film 9 of the liquid 7 due to the piezoelectric element 45 being driven based on the preparation signals S2 and S3 from the control section 6 and the pressure of the liquid 7 inside the liquid chamber 43 being lowered and the pseudo-nozzle spanning from the first nozzle portion 51 to the second nozzle portion 52 is formed inside the nozzle portion 50.

When the discharge signal S4 is supplied to the piezoelectric element 45 at an appropriate timing, that is, at the timing at which the meniscus (the liquid surface 8) is maximally drawn in to the +Z-direction, the piezoelectric element 45 expands, the diaphragm 46 deforms in the −Z-direction, the liquid chamber 43 contracts, the pressure of the liquid 7 inside the liquid chamber 43 rises, and a force in the −Z-direction acts on the liquid 7. The liquid 7 is drawn out to the opening 53 side by the force in the −Z-direction and is discharged from the pseudo-nozzle as the droplet 10*a*.

The pseudo-nozzle is a void formed in the liquid 7 and the liquid 7 is present on both ends of the liquid surface 8 (the sides of the directions intersecting the Z-directions with respect to the void) without the liquid 7 being present on the −Z-direction side with respect to the liquid surface 8 positioned at the end on the +Z-direction side of the void. Since, as the apex 8*a* of the liquid surface 8 is approached, the liquid surface 8 distances from the liquid 7 present on both ends of the liquid surface 8 and influence is less easily received from the liquid 7 present at both ends of the liquid surface 8, when the liquid 7 at the liquid surface 8 positioned on the end on the +Z-direction side of the void flows in the −Z-direction, the liquid 7 flows more easily as the apex 8*a* of the liquid surface 8 is approached from the inner wall surface 51*a*.

Therefore, at the initial stage at which the discharge signal S4 is supplied to the piezoelectric element 45, when the pressure of the liquid 7 inside the liquid chamber 43 rises, a force acts on the liquid 7 in the −Z-direction, and the liquid 7 in the liquid surface 8 positioned at the end on the +Z-direction side of the void flows in the −Z-direction, as depicted by the dashed line in FIG. 8, the shape of the apex 8*a* of the liquid surface 8 inverts from a shape recessed toward the +Z-direction to a protruding shape facing the −Z-direction.

In other words, at the initial stage at which the piezoelectric element 45 is driven based on the discharge signal S4 from the control section 6, the shape of the apex 8*a* of the liquid surface 8 inverts to a protruding shape facing the opening 53 side.

When the shape of the apex 8*a* of the liquid surface 8 inverts to a protruding shape facing the opening 53 side, an apex 8*b* in which the liquid surface 8 has a shape protruding to the liquid chamber 43 side is formed in the periphery of the apex 8*a* of the liquid surface 8. A liquid column 10 having a protruding shape on the opening 53 side is formed between the apex 8*a* of the liquid surface 8 and the apex 8*b* of the liquid surface 8. In other words, the liquid column 10 having the protruding shape on the opening 53 side is formed on the inside of the pseudo-nozzle.

The center portion of the liquid surface in the present application is a region in which the liquid column 10 is formed in the liquid surface 8. Since the liquid column 10 is formed in the periphery of the apex 8*a* of the liquid surface 8 including the apex 8*a* of the liquid surface 8, the apex 8*a* of the liquid surface 8 is encompassed by the center portion of the liquid surface in the present application.

Since the second nozzle portion 52 is thicker than the first nozzle portion 51, the flow path resistance of the second nozzle portion 52 is smaller than the flow path resistance of the first nozzle portion 51. When a force acts on the liquid 7 in the −Z-direction in the second nozzle portion 52 having the small flow path resistance, the flow velocity of the liquid 7 which flows in the −Z-direction increases as compared to a case in which a force acts on the liquid 7 in the −Z-direction in the first nozzle portion 51 having the large flow path resistance. Meanwhile, when a force acts on the liquid 7 in the −Z-direction in the first nozzle portion 51 having the large flow path resistance, the flow velocity of the liquid 7 flowing in the −Z-direction decreases.

In this manner, in the present embodiment, when the discharge signal S4 is supplied to the piezoelectric element 45, the liquid 7 is pushed out to the opening 53 side, and the liquid 7 is caused to flow in the −Z-direction, a force is caused to act on the liquid 7 in the −Z-direction in the second nozzle portion 52 having a small flow path resistance and the flow velocity of the liquid 7 flowing in the −Z-direction is increased.

In detail, in the present embodiment, after causing the shape of the apex 8*a* of the liquid surface 8 to invert to a protruding shape facing the opening 53 side, the second control which maximizes the flow velocity of the apex 8*b* on the liquid chamber 43 side of the liquid surface 8 of the liquid 7 in the region of the second nozzle portion 52 is carried out and the flow velocity of the liquid 7 flowing in the −Z-direction is increased.

Since the liquid 7 flowing in the −Z-direction flows more easily as the apex 8*a* of the liquid surface 8 is approached, when a force acts on the liquid 7 in the −Z-direction, the distance between the apex 8*a* of the liquid surface 8 and the apex 8*b* (the end portion) of the liquid surface 8 gradually increases and the liquid column 10 becomes longer as depicted by the dot-dash line in FIG. 8.

When the liquid 7 flowing in the −Z-direction moves close to the opening 53, as depicted by the solid line in FIG. 8, the liquid column 10 becomes still longer and the liquid column 10 jumps out to the outside from the first nozzle portion 51.

When the sum of the energy applied to the liquid column 10 exceeds the energy at which the liquid column 10 separates from the liquid surface 8, the liquid column 10 is discharged from the apex 8*a* of the liquid surface 8 as the droplet 10*a* as illustrated in FIG. 9.

In this manner, in the present embodiment, due to the piezoelectric element 45 being driven based on the discharge signal S4 from the control section 6 and the pressure of the liquid 7 inside the liquid chamber 43 rising in a state in which the inner wall surface 51*a* is covered by the liquid film 9, the second control in which the shape of the apex 8*a* of the liquid surface 8 is inverted to a protruding shape facing the opening 53 side and the liquid 7 is further discharged from the apex 8*a* of the liquid surface 8 having a protruding shape is executed.

When the signal S5 is supplied to the piezoelectric element 45, the shapes of the piezoelectric element 45 and the diaphragm 46 are maintained at fixed shaped and the liquid 7 is supplied to the liquid chamber 43 and the nozzle portion 50 via the supply flow path 42. The liquid discharging head 41 returns to a stable state in which the outer circumferential edge of the liquid surface 8 of the liquid 7 is positioned at the opening 53 of the first nozzle portion 51.

Figure 10:
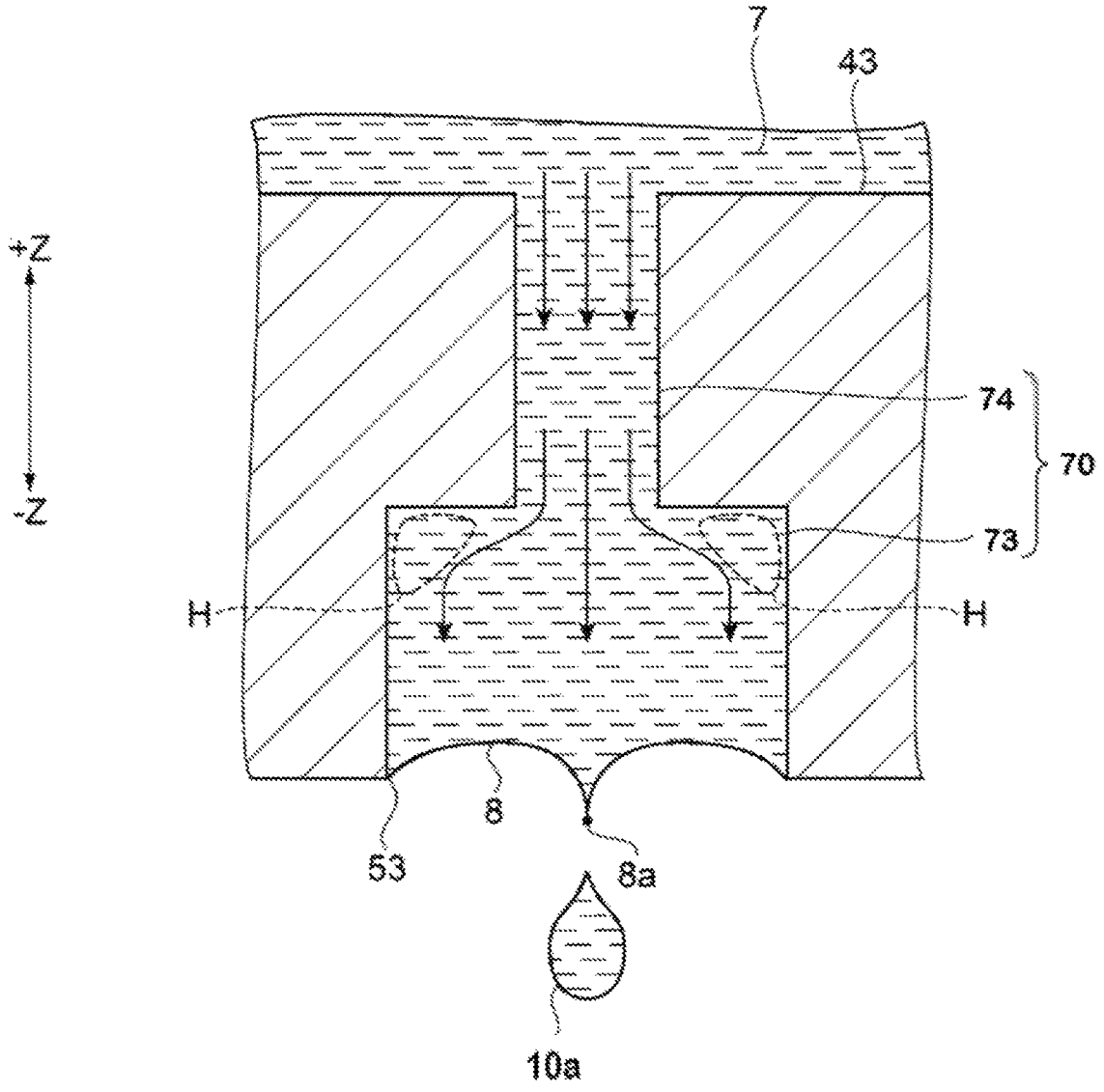
FIG. 10 is a schematic diagram illustrating a state in which a liquid is discharged from a nozzle portion of a comparative example as a droplet.

FIG. 10 is a diagram corresponding to FIG. 9 and is a schematic diagram illustrating a state in which the liquid 7 is discharged from a nozzle portion 70 of a comparative example as the droplet 10*a*. In FIG. 10, the flow of the liquid 7 which flows according to the discharge signal S4 supplied from the control section 6 to the piezoelectric element 45 is depicted by arrows.

In FIG. 9 the flow of the liquid 7 which flows according to the discharge signal S4 supplied from the control section 6 to the piezoelectric element 45 is also depicted by arrows.

In the nozzle portion 70 of the comparative example, a first nozzle portion 71 is thicker than a second nozzle portion 72. In the nozzle portion 50 of the present embodiment, the first nozzle portion 51 is thinner than the second nozzle portion 52. This is the differentiating point between the nozzle portion 70 of the comparative example and the nozzle portion 50 of the present embodiment.

As illustrated in FIG. 10, in the nozzle portion 70 of the comparative example of a configuration in which the first nozzle portion 71 is thicker than the second nozzle portion 72, when a force in the −Z-direction is caused to act on the liquid 7 forming the liquid surface 8 and the liquid 7 is caused to flow in the −Z-direction, a region H (the region H surrounded by the dashed lines in FIG. 10) in which the liquid 7 does not flow easily arises inside the first nozzle portion 71. In other words, in the nozzle portion 70 of the comparative example, a portion in which the force in the −Z-direction is not easily transmitted arises easily inside the first nozzle portion 71 and loss of the force occurs easily.

As illustrated in FIG. 9, in the nozzle portion 50 of the present embodiment of a configuration in which the first nozzle portion 51 is thinner than the second nozzle portion 52, when a force in the −Z-direction is caused to act on the liquid 7 forming the liquid surface 8 and the liquid 7 is caused to flow in the −Z-direction, a region in which the liquid 7 does not flow easily does not arise inside the first nozzle portion 51, the force in the −Z-direction is efficiently transmitted to the inside of the first nozzle portion 51, and loss of the force does not occur easily.

As described above, in the present embodiment, first, the first control in which the preparation signals S2 and S3 are supplied to the piezoelectric element 45 and the pressure of the liquid 7 inside the liquid chamber 43 is lowered to draw in the liquid 7 inside the nozzle portion 50 to the liquid chamber 43 side is executed and the pseudo-nozzle spanning from the first nozzle portion 51 to the second nozzle portion 52 is formed at a uniform thickness.

Since the pseudo-nozzle is formed on the inside of the liquid film 9 covering the inner wall surface 51*a* of the first nozzle portion 51, the diameter of the pseudo-nozzle is shorter than the diameter D1 of the first nozzle portion 51 by an amount corresponding to the thickness of the liquid film 9. In other words, the pseudo-nozzle which is narrower than the first nozzle portion 51 is formed on the inside of the liquid film 9 due to the liquid film 9 which covers the inner wall surface 51*a* of the first nozzle portion 51. The diameter of the pseudo-nozzle changes according to the kind of the liquid 7, the waveform of the drive signal DS1, the configuration material of the first nozzle portion 51, and the like. In the present embodiment, the diameter of the pseudo-nozzle is approximately 70% of the diameter D1 of the first nozzle portion 51.

In this manner, according to the first control, the pseudo-nozzle which functions as an effective nozzle when discharging the liquid 7 from the first nozzle portion 51 as the droplet 10*a* is formed on the inside of the first nozzle portion 51 at a thinner diameter than the diameter D1 of the first nozzle portion 51.

It is preferable for the configuration material of the nozzle portion 50 to be a material having excellent wetting properties with respect to the liquid 7 in order to stably form the pseudo-nozzle spanning from the first nozzle portion 51 to the second nozzle portion 52.

In the present embodiment, next, the second control in which the discharge signal S4 is supplied to the piezoelectric element 45, the pressure of the liquid 7 inside the liquid chamber 43 is raised, the liquid 7 inside the nozzle portion 50 is pushed out to the opening 53 side, the shape of the apex 8*a* of the liquid surface 8 is inverted to a protruding shape facing the opening 53, the liquid column 10 is formed inside the pseudo-nozzle, and the droplet 10*a* smaller than the diameter of the pseudo-nozzle is discharged from the pseudo-nozzle is executed. The size of the droplet 10*a* discharged from the pseudo-nozzle is approximately 50% of the diameter of the pseudo-nozzle.

Since the diameter of the pseudo-nozzle is approximately 70% of the diameter D1 of the first nozzle portion 51, it is possible to discharge the droplet 10*a* of a small size of approximately 35% of the diameter D1 of the first nozzle portion 51 from the first nozzle portion 51.

The inventor considers that the minimum value of the size of the droplet to be discharged from the first nozzle portion 51 according to the related art is approximately 50% of the diameter D1 of the first nozzle portion 51. In the present embodiment, the size of the droplet to be discharged from the first nozzle portion 51 is approximately 70% smaller as compared to the related art and it is possible to discharge the droplet 10*a* of a small size of approximately 35% of the diameter D1 of the first nozzle portion 51.

Therefore, the printer 2 provided in the liquid discharging head 41 according to the present embodiment is capable of forming minute dots on the recording medium 3 by discharging the droplet 10*a* of a smaller diameter as compared to the related art and obtaining a high resolution image formed on the recording medium 3.

Hypothetically, when the liquid 7 is a high-viscosity liquid containing a solid component such as a filler and it is necessary to increase the size of the diameter D1 of the first nozzle portion 51 for preventing clogging of the nozzle portion 50 by the solid component, in the related art, when the diameter D1 of the first nozzle portion 51 is increased in size, the droplet 10*a* discharged from the first nozzle portion 51 increases in size and the dot formed on the recording medium 3 increases in size. In the present embodiment, since the droplet 10*a* discharged from the first nozzle portion 51 is small as compared to the related art, even when the diameter D1 of the first nozzle portion 51 increases, it is possible to suppress an increase in the size of the dot formed on the recording medium 3.

In other words, according to the configuration of the present embodiment, since it is possible to increase the diameter D1 of the first nozzle portion 51 while suppressing an increase in the size of the dot formed on the recording medium 3, it is possible to stably discharge a high-viscosity liquid containing a solid component such as a filler in which nozzle clogging occurs easily without leading to a decrease in the quality of the image formed on the recording medium 3.

In the present embodiment, since the liquid 7 is discharged as the droplet 10*a* in a state in which the inner wall surface 51*a* of the first nozzle portion 51 is covered by the liquid film 9, the end portion (the apex on the liquid chamber 43 side of the liquid surface 8) of the liquid column 10 is pressurized by the liquid 7 which flows into the first nozzle portion 51 in a state in which the end portion is in contact with the liquid 7 inside the first nozzle portion 51. Therefore, as compared to a case in which the liquid film 9 is not present between the inner wall surface 51*a* of the first nozzle portion 51 and the liquid 7 discharged as the droplet 10*a* and the liquid 7 discharged as the droplet 10*a* flows while in contact with the inner wall surface 51*a* of the first nozzle portion 51, the force (for example, a frictional force) impeding the flowing of the liquid 7 acting on the liquid 7 in the vicinity of the boundary between the liquid 7 and the inner wall surface 51*a* of the first nozzle portion 51 is weaker, the liquid 7 discharged as the droplet 10*a* flows more easily, and the energy loss of the liquid 7 discharged from the first nozzle portion 51 is smaller. As a result, even if the viscosity of the liquid 7 is high, the liquid discharging head 41 more easily stably discharges the liquid 7, is capable of efficiently discharging the high-viscosity liquid, and additionally, is capable of increasing the flight speed of the discharged liquid 7.

Therefore, as compared to the related art, in the printer 2 provided with the liquid discharging head 41 according to the present embodiment, the flight speed of the liquid 7 discharged from the first nozzle portion 51 is faster and it is possible to more swiftly form the image on the recording medium 3 and to increase the productivity of the printer 2.

As compared to the related art, in the present embodiment, since the energy loss of the liquid 7 discharged from the first nozzle portion 51 is smaller, even if the pressure applied from the piezoelectric element 45, it is possible to discharge the liquid 7 at an equal flight speed to the related art. In other words, as compared to the related art, in the present embodiment, even if the pressure applied from the piezoelectric element 45 is weakened, it is possible to obtain equal discharging performance to the related art. When the pressure applied from the piezoelectric element 45 is weakened, since it is possible to reduce the rigidity of the piezoelectric element 45 and it is possible to reduce the rigidity of the fixing plate 413 and the flow path forming substrate 414, it is possible to reduce the size of the liquid discharging head 41.

Therefore, when the printer 2 provided with the liquid discharging head 41 according to the present embodiment has an equal discharging performance to the related art, it is possible to reduce the size of the printer 2 as compared to the related art.

Second Embodiment

Figure 11:
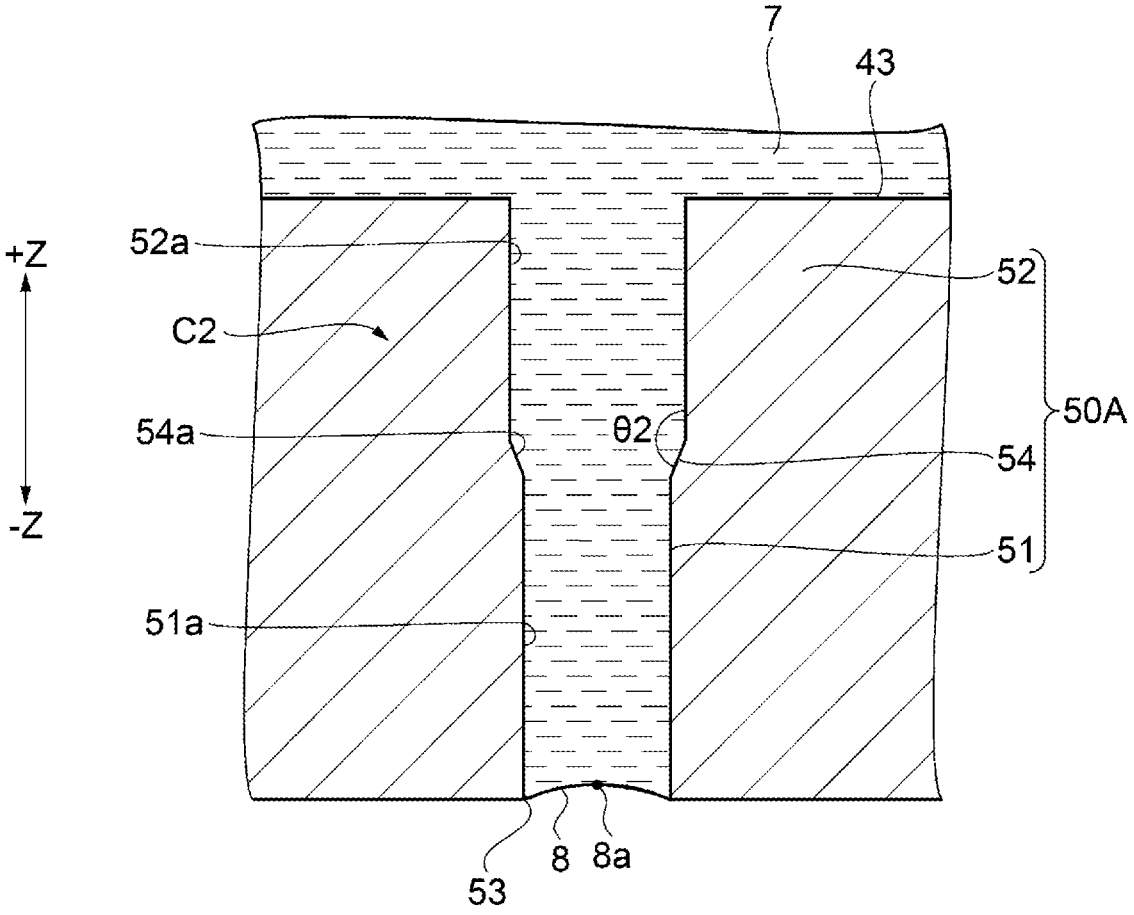
FIG. 11 is an enlarged view illustrating a state of a nozzle portion in a liquid discharging head according to a second embodiment.

FIG. 11 is a view corresponding to FIG. 5 and is an enlarged view illustrating a state of a nozzle portion 50A in a liquid discharging head according to the second embodiment.

The shape of the nozzle portion is different between the liquid discharging head according to the present embodiment and the liquid discharging head 41 according to the first embodiment.

Hereinafter, a description will be given of the outline of the liquid discharging head according to the present embodiment centered on the differences from the first embodiment with reference to FIG. 11. Components which are the same as those in the first embodiment will be given the same reference numerals and duplicate descriptions will be omitted.

As illustrated in FIG. 11, the nozzle portion 50*a* in the liquid discharging head according to the present embodiment includes the first nozzle portion 51 which discharges the liquid 7 onto the recording medium 3 as the droplet 10*a*, the second nozzle portion 52 which communicates with the liquid chamber 43, and a nozzle connection portion 54 which communicates the first nozzle portion 51 and the second nozzle portion 52 with each other. The nozzle connection portion 54 includes an inclined surface 54*a* inclined with respect to the Z-direction.

In other words, the liquid discharging head according to the present embodiment includes the nozzle connection portion 54 having a tapered shape between the first nozzle portion 51 and the second nozzle portion 52. Meanwhile, in the liquid discharging head 41 of the first embodiment, the second nozzle portion 52 is connected to the first nozzle portion 51 and the liquid discharging head 41 does not include the nozzle connection portion having a tapered shape between the first nozzle portion 51 and the second nozzle portion 52. This is the main differentiating point between the present embodiment and the first embodiment.

The inner wall surface 51*a* of the first nozzle portion 51 is connected to the inner wall surface 52*a* of the second nozzle portion 52 via the inclined surface 54*a* of the nozzle connection portion 54. An angle θ2 of a corner portion C2 formed by the inner wall surface 52*a* and the inclined surface 54*a* is an obtuse angle greater than 90°.

Meanwhile, in the first embodiment, the inner wall surface 51*a* of the first nozzle portion 51 is connected to the inner wall surface 52*a* of the second nozzle portion 52 via the base surface 52*b* of the second nozzle portion 52. The angle θ1 of the corner portion C1 formed by the inner wall surface 52*a* and the base surface 52*b* is a right angle (90°) (refer to FIG. 5).

The piezoelectric element 45 is driven based on the discharge signal S4 from the control section 6, the pressure of the liquid 7 inside the liquid chamber 43 rises, and the liquid 7 flows from the second nozzle portion 52 toward the first nozzle portion 51.

For example, when the angle θ1 of the corner portion C1 formed by the inner wall surface 52*a* and the base surface 52*b* is 90° or when the angle θ1 of the corner portion C1 is an acute angle lesser than 90°, the liquid 7 flowing from the second nozzle portion 52 toward the first nozzle portion 51 may be retained at the corner portion C1. Hypothetically, when the liquid 7 is retained at the corner portion C1 and bubbles are contained in the liquid 7, the bubbles are more easily trapped at the corner portion C1. When the bubbles are trapped at the corner portion C1, the energy loss of the liquid 7 discharged from the first nozzle portion 51 increases and discharge faults when the liquid 7 is discharged from the first nozzle portion 51 occur more easily.

In the present embodiment, the nozzle connection portion 54 is provided between the first nozzle portion 51 and the second nozzle portion 52, the corner portion C2 corresponding to the corner portion C1 in the first embodiment is formed by the inner wall surface 52*a* of the second nozzle portion 52 and the inclined surface 54*a* of the nozzle connection portion 54, and the angle θ2 of the corner portion C2 is an obtuse angle greater than 90°.

When the angle θ2 of the corner portion C2 is acute, in comparison to the configuration in which the angle θ1 of the corner portion C1 is a right angle, the liquid 7 flowing from the second nozzle portion 52 toward the first nozzle portion 51 is not easily retained at the corner portion C2, and hypothetically, even if bubbles are contained in the liquid 7, the bubbles are not easily trapped at the corner portion C2.

Third Embodiment

Figure 12:
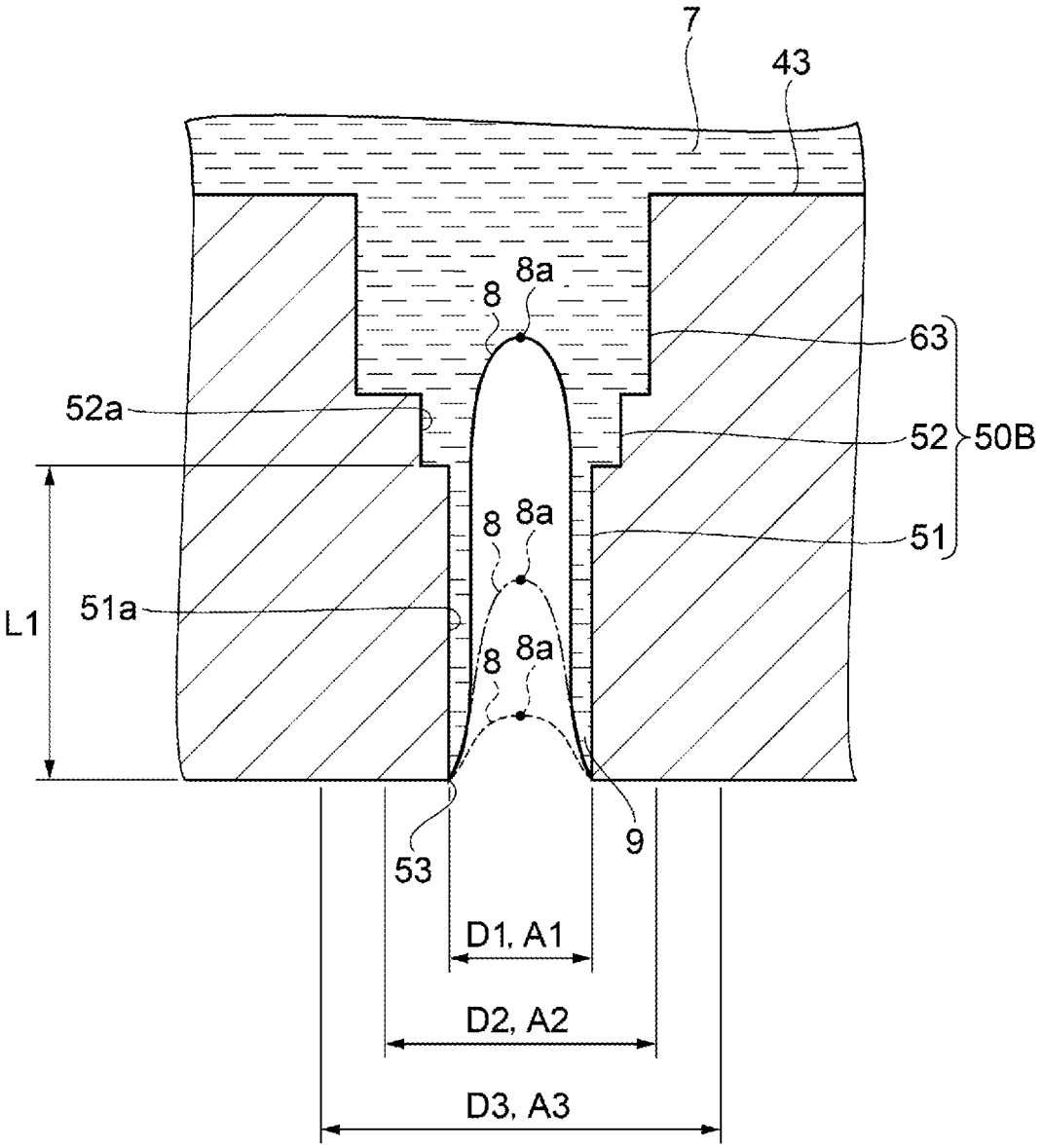
FIG. 12 is an enlarged view illustrating a state of a nozzle portion in a liquid discharging head according to a third embodiment.

FIG. 12 is a view corresponding to FIG. 7 and is an enlarged view illustrating a state of a nozzle portion 50B in a liquid discharging head according to the third embodiment. FIG. 12 depicts the state of the liquid surface 8 when the preparation signals S2 and S3 are supplied from the control section 6 to the piezoelectric element 45.

The shape of the nozzle portion is different between the liquid discharging head according to the present embodiment and the liquid discharging head 41 according to the first embodiment.

Hereinafter, a description will be given of the outline of the liquid discharging head according to the present embodiment centered on the differences from the first embodiment with reference to FIG. 12. Components which are the same as those in the first embodiment will be given the same reference numerals and duplicate descriptions will be omitted.

As illustrated in FIG. 12, the nozzle portion 50B in the liquid discharging head according to the present embodiment includes the first nozzle portion 51 having the first sectional area A1, the second nozzle portion 52 which communicates with the first nozzle portion 51 and has the second sectional area A2 which is larger than the first sectional area A1, and a third nozzle portion 63 positioned closer to the liquid chamber 43 side than the second nozzle portion 52 and having a third sectional area A3 larger than the second sectional area A2.

Meanwhile, the nozzle portion 50 in the liquid discharging head 41 according to the first embodiment includes the first nozzle portion 51 having the first sectional area A1 and the second nozzle portion 52 which communicates with the first nozzle portion 51 and has the second sectional area A2 which is larger than the first sectional area A1.

This is the main differentiating point between the present embodiment and the first embodiment.

In the present embodiment, the first control in which the apex 8*a* of the liquid surface 8 of the liquid 7 is drawn into the third nozzle portion 63 in a state in which the inner wall surface 51*a* of the first nozzle portion 51 is covered by the liquid film 9 of the liquid 7 by driving the piezoelectric element 45 based on the preparation signals S2 and S3 from the control section 6 and lowering the pressure of the liquid 7 inside the liquid chamber 43 and the pseudo-nozzle spanning from the first nozzle portion 51 to the third nozzle portion 63 is formed inside the nozzle portion 50B.

Next, by driving the piezoelectric element 45 based on the discharge signal S4 from the control section 6 and raising the pressure of the liquid 7 inside the liquid chamber 43 in a state in which the inner wall surface 51*a* is covered by the liquid film 9, the second control in which the shape of the apex 8*a* of the liquid surface 8 is inverted to a protruding shape facing the opening 53 side inside the third nozzle portion 63 and the liquid 7 is further discharged from the apex 8*a* of the liquid surface 8 having a protruding shape is executed.

Since the second nozzle portion 52 is thicker than the third nozzle portion 63, the flow path resistance of the third nozzle portion 63 is smaller than the flow path resistance of the second nozzle portion 52. When a force acts on the liquid 7 in the −Z-direction in the third nozzle portion 63 having the small flow path resistance, it is possible to increase the flow velocity of the liquid 7 which flows in the −Z-direction as compared to a configuration in which a force acts on the liquid 7 in the −Z-direction in the second nozzle portion 52 having the large flow path resistance. Since the liquid 7 having the high flow velocity flows in the second nozzle portion 52 and the first nozzle portion 51 and is discharged from the pseudo-nozzle inside the first nozzle portion 51 as the droplet 10*a*, the discharge speed of the droplet 10*a* discharged from the pseudo-nozzle increases.

In this manner, the present embodiment includes a configuration in which a different nozzle portion (the second nozzle portion 52) is provided between a nozzle portion (the third nozzle portion 63) in which the liquid 7 is pressurized and the shape of the liquid surface 8 is inverted and a nozzle portion (the first nozzle portion 51) which discharges the liquid 7.

The number of different nozzle portions provided between a nozzle portion (the third nozzle portion 63) in which the liquid 7 is pressurized and the shape of the liquid surface 8 is inverted and a nozzle portion (the first nozzle portion 51) which discharges the liquid 7 may be plural instead of singular.

When the number of different nozzle portions provided between a nozzle portion (the third nozzle portion 63) in which the liquid 7 inverts the shape of the liquid surface 8 and a nozzle portion (the first nozzle portion 51) which discharges the liquid 7 is plural, at least a portion of the plurality of different nozzle portions may be a nozzle connection portion having a tapered shape (for example, the nozzle connection portion 54 of the second embodiment).

The present disclosure is not limited to the embodiments, may be modified, as appropriate, within a scope not departing from the gist or intent of the disclosure as may be inferred from the disclosure and the entire specification, and various modification examples are conceivable outside of the embodiments. Hereinafter, a description will be given of modification examples.

Modification Example 1

Figure 13:
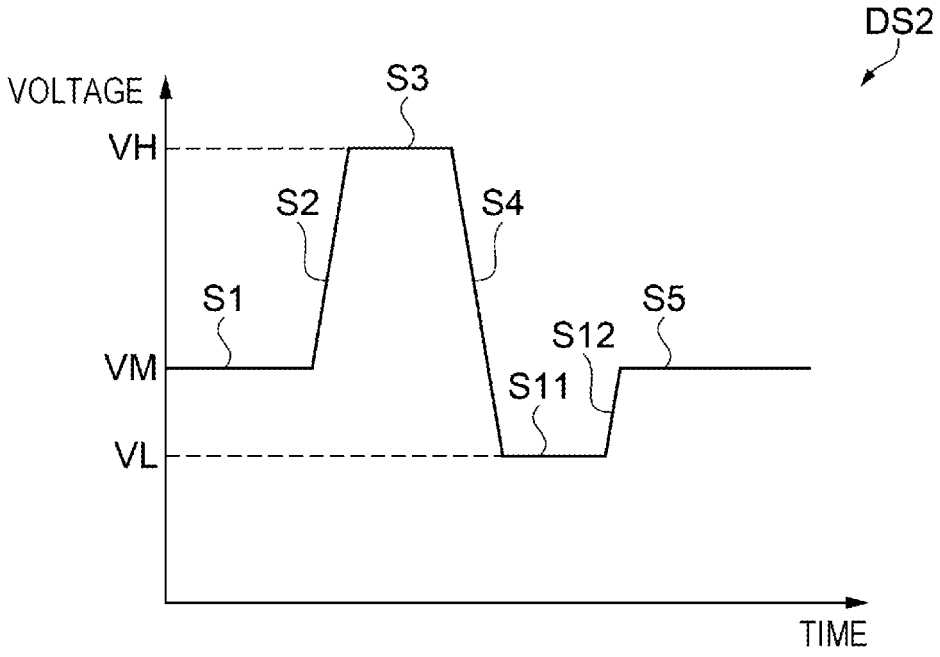
FIG. 13 is a schematic diagram illustrating a state of a drive signal according to modification example 1.

FIG. 13 is a diagram corresponding to FIG. 6 and is a schematic diagram illustrating a state of a drive signal DS2 according to modification example 1.

As illustrated in FIG. 13, the drive signal supplied from the control section 6 to the piezoelectric element 45 may be the drive signal DS2. The drive signal DS2 supplied from the control section 6 to the piezoelectric element 45 includes the signal S1 which is set between a lowest drive voltage VL and the highest drive voltage VH and is the starting point of the drive signal DS2, the preparation signals S2 and S3, the discharge signal S4, a signal S11, a signal S12, and the signal S5 which is the end point of the drive signal DS2.

The drive signal DS2 according to the present modification example is different from the drive signal DS1 according to the first embodiment in newly including the signals S11 and S12 between the discharge signal S4 and the signal S5 of the end point.

When the signal S11 is supplied to the piezoelectric element 45, a state in which the piezoelectric element 45 is expanded is maintained and a state in which the liquid 7 inside the first nozzle portion 51 is pushed out toward the opening 53 is maintained.

When the signal S12 is supplied to the piezoelectric element 45, the piezoelectric element 45 contracts, the diaphragm 46 deforms in the +Z-direction, the liquid chamber 43 expands, the pressure of the liquid 7 in the liquid chamber 43 drops, and the liquid 7 inside the first nozzle portion 51 is drawn into the liquid chamber 43 side. In other words, the liquid 7 inside the first nozzle portion 51 changes from a state of being pushed out toward the opening 53 to a state of being drawn into the liquid chamber 43 side.

When the liquid 7 inside the first nozzle portion 51 changes from the state of being pushed out toward the opening 53 to the state of being drawn into the liquid chamber 43 side, the liquid column 10 which jumps out to the outside from the first nozzle portion 51 depicted by the solid line in FIG. 8 separates more easily from the liquid surface 8 of the liquid 7. As a result, as illustrated in FIG. 9, the liquid column 10 is more easily discharged from the apex 8*a* of the liquid surface 8 as the droplet 10*a* and the liquid 7 from the liquid discharging head 41 is more easily stably discharged as the droplet 10*a*.

Modification Example 2

Figure 14:
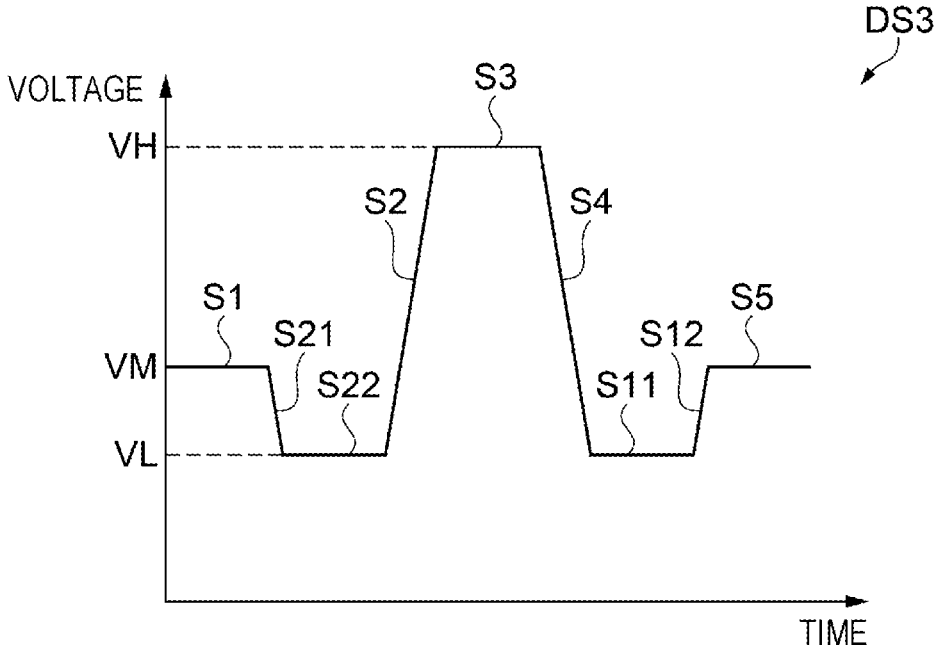
FIG. 14 is a schematic diagram illustrating a state of a drive signal according to modification example 2.

FIG. 14 is a diagram corresponding to FIG. 6 and is a schematic diagram illustrating a state of a drive signal DS3 according to modification example 2.

As illustrated in FIG. 14, the drive signal supplied from the control section 6 to the piezoelectric element 45 may be the drive signal DS3. The drive signal DS3 supplied from the control section 6 to the piezoelectric element 45 includes the signal S1 which is set between a lowest drive voltage VL and the highest drive voltage VH and is the starting point of the drive signal DS3, a signal S21, a signal S22, the preparation signals S2 and S3, the discharge signal S4, the signal S11, the signal S12, and the signal S5 which is the end point of the drive signal DS3.

The drive signal DS3 according to the present modification example is different from the drive signal DS2 according to modification example 1 in newly including the signals S21 and S22 between the signal S1 which is the starting point and the preparation signals S2 and S3.

When the signals S21 and S22 are supplied to the piezoelectric element 45, a state is assumed in which the piezoelectric element 45 expands, the diaphragm 46 deforms in the −Z-direction, the liquid chamber 43 contracts, the pressure of the liquid 7 inside the liquid chamber 43 rises, and the liquid 7 is pushed out toward the opening 53 side. Therefore, although not depicted in the drawings, the outer circumferential edge of the liquid surface 8 of the liquid 7 is positioned at the opening 53 of the first nozzle portion 51 and the apex 8*a* of the liquid surface 8 assumes a state of projecting out to the outside of the opening 53 of the first nozzle portion 51.

Next, the first control in which the apex 8*a* of the liquid surface 8 of the liquid 7 is drawn into the second nozzle portion 52 in a state in which the inner wall surface 51*a* of the first nozzle portion 51 is covered by the liquid film 9 of the liquid 7 by supplying the preparation signals S2 and S3 to the piezoelectric element 45, causing the piezoelectric element 45 to contract and lowering the pressure of the liquid 7 inside the liquid chamber 43.

When the liquid 7 is drawn in toward the liquid chamber 43 side from a state in which the liquid 7 is pushed out toward the opening 53 side and the liquid surface 8 projects out to the outside of the first nozzle portion 51, the drawn-in amount of the liquid 7 drawn into the second nozzle portion 52 from the first nozzle portion 51 stabilizes and it is possible to reduce variation in the length in the Z-direction of the pseudo-nozzle formed spanning from the first nozzle portion 51 to the second nozzle portion 52.

Therefore, in addition to the effect of the first modification example that it becomes easier to stably discharge the liquid 7 from the liquid discharging head 41 as the droplet 10*a*, it is possible to obtain an effect of the length in the Z-direction of the pseudo-nozzle formed spanning from the first nozzle portion 51 to the second nozzle portion 52 being uniform.

Modification Example 3

Figure 15:
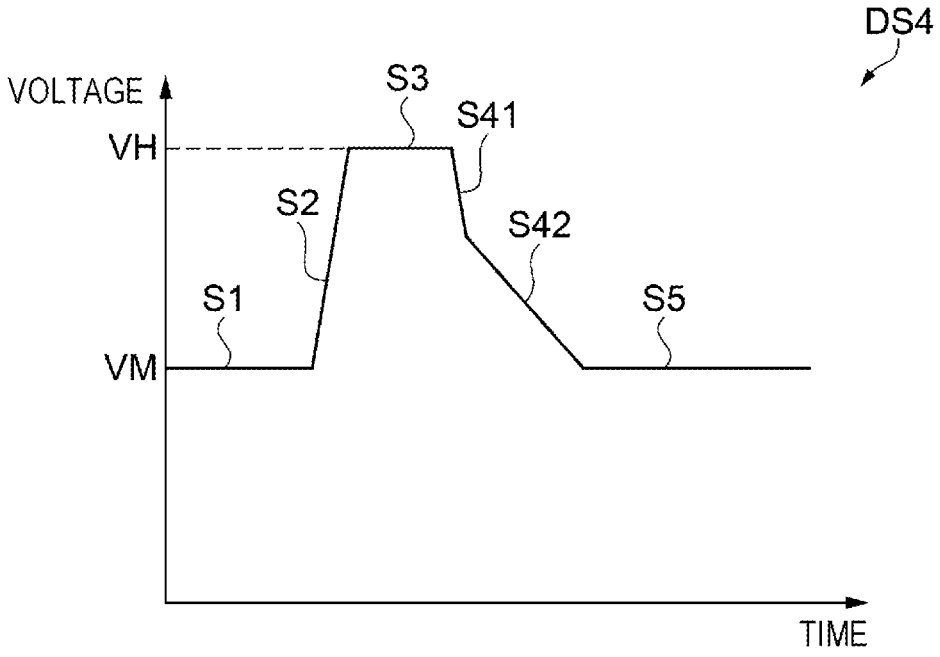
FIG. 15 is a schematic diagram illustrating a state of a drive signal according to modification example 3.

FIG. 15 is a diagram corresponding to FIG. 6 and is a schematic diagram illustrating a state of a drive signal DS4 according to modification example 3.

As illustrated in FIG. 15, the drive signal supplied from the control section 6 to the piezoelectric element 45 may be the drive signal DS4. The drive signal DS4 supplied from the control section 6 to the piezoelectric element 45 contains the signal S1 which is a starting point of the drive signal DS4, the preparation signals S2 and S3, discharge signals S41 and S42, and the signal S5 which is an end point of the drive signal DS4.

In other words, the discharge signal which executes the second control differs from the drive signal DS4 according to the present modification example and the drive signal DS1 according to the first embodiment.

In the present modification example, by driving the piezoelectric element 45 based on the discharge signals S41 and S42 and raising the pressure of the liquid 7 inside the liquid chamber 43 in a state in which the inner wall surface 51*a* is covered by the liquid film 9, the shape of the apex 8*a* of the liquid surface 8 is inverted to a protruding shape facing the opening 53 side inside the second nozzle portion 52 and the liquid 7 is further discharged from the apex 8*a* of the liquid surface 8 having a protruding shape is executed.

The discharge signal S41 is a trigger for an operation of inverting the shape of the apex 8*a* of the liquid surface 8 to a protruding shape facing the opening 53 side. When the discharge signal S41 is supplied to the piezoelectric element 45 before the discharge signal S42 is supplied to the piezoelectric element 45, it is possible to stably invert the shape of the apex 8*a* of the liquid surface 8 inside the second nozzle portion 52 using the discharge signal S42.

Modification Example 4

Figure 16:
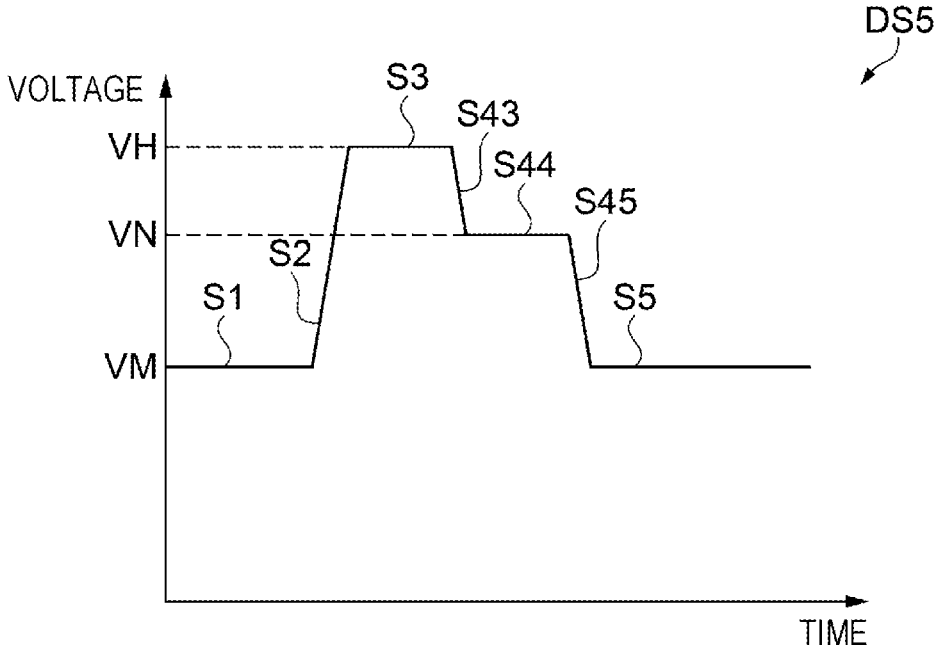
FIG. 16 is a schematic diagram illustrating a state of a drive signal according to modification example 4.

FIG. 16 is a diagram corresponding to FIG. 6 and is a schematic diagram illustrating a state of a drive signal DS5 according to modification example 4.

As illustrated in FIG. 16, the drive signal supplied from the control section 6 to the piezoelectric element 45 may be the drive signal DS5. The drive signal DS5 supplied from the control section 6 to the piezoelectric element 45 contains the signal S1 which is a starting point of the drive signal DS5, the preparation signals S2 and S3, discharge signals S43, S44, and S45, and the signal S5 which is an end point of the drive signal DS5.

In other words, the discharge signal which executes the second control differs from the drive signal DS5 according to the present modification example and the drive signal DS1 according to the first embodiment.

The discharge signals S43 and S44 are signals which lower the voltage from the highest drive voltage VH to the drive voltage VN, cause the liquid chamber 43 to contract, and create an opportunity for the operation of inverting the shape of the apex 8*a* of the liquid surface 8 to a protruding shape facing the opening 53 side. The discharge signal S45 is a signal which lowers the voltage from the drive voltage VN to the reference drive voltage VM, causes the liquid chamber 43 to further contract, inverts the shape of the apex 8*a* of the liquid surface 8 to a protruding shape facing the opening 53 side, and subsequently discharges the liquid 7 from the apex 8*a* of the liquid surface 8 having a protruding shape.

When the discharge signals S43 and S44 are supplied to the piezoelectric element 45 before the discharge signal S45 is supplied to the piezoelectric element 45, it is possible to stably invert the shape of the apex 8*a* of the liquid surface 8 inside the second nozzle portion 52 using the discharge signal S45.

Modification Example 5

In addition to the supply flow path 42 which supplied the liquid 7 to the liquid chamber 43, the liquid discharging head 41 may be configured to include a circulation flow path which circulates the liquid 7 inside the liquid chamber 43.

When the circulation flow path is used to circulate the liquid 7 inside the liquid chamber 43, for example, when heavy particles such as metal particles are contained in the liquid 7, the heavy particles precipitate less easily and the liquid 7 thickens even less easily.

Hereinafter, a description will be given of content derived from the embodiments.

According to an aspect of the disclosure, there is provided a liquid discharging head mounted on a liquid discharging apparatus that is provided with a control section which performs discharge control on a liquid as a droplet, the liquid discharging head including a first nozzle portion which discharges the liquid from a distal end and has a first sectional area, a second nozzle portion which communicates with the first nozzle portion and has a second sectional area larger than the first sectional area, a liquid chamber which communicates with the second nozzle portion, and a pressure changing section which changes a pressure of the liquid inside the liquid chamber, in which the pressure changing section is driven based on a drive signal from the control section, and the liquid discharging head executes a first control in which a center portion of a liquid surface of the liquid is drawn into the second nozzle portion in a state in which an inner wall surface of the first nozzle portion is covered by a liquid film of the liquid by lowering the pressure of the liquid inside the liquid chamber, and a second control in which a shape of the center portion of the liquid surface is inverted to a protruding shape facing the distal end side and the liquid is further discharged from the center portion of the liquid surface having a protruding shape by raising the pressure of the liquid inside the liquid chamber in a state in which the inner wall surface is covered by the liquid film.

When the liquid is discharged in a state in which the inner wall surface of the first nozzle portion is covered by the liquid film, the liquid film is present between the inner wall surface of the first nozzle portion and the liquid to be discharged, and the liquid to be discharged flows while in contact with the liquid film. Therefore, as compared to a case in which the liquid film is not present between the inner wall surface of the first nozzle portion and the liquid to be discharged and the liquid to be discharged flows while in contact with the inner wall surface of the first nozzle portion, the force (for example, a frictional force) impeding the flowing of the liquid acting on the liquid in the vicinity of the boundary between the liquid and the inner wall surface of the first nozzle portion is weaker. As a result, even if the viscosity of the liquid is high, the liquid discharging head more easily stably discharges the liquid and is capable of efficiently discharging the high-viscosity liquid.

When the liquid film is present between the inner wall surface of the first nozzle portion and the liquid to be discharged, the diameter of the portion (hereinafter referred to as the pseudo-nozzle) which functions effectively as a nozzle when discharging the liquid from the first nozzle portion is narrowed by an amount corresponding to the thickness of the liquid film. Therefore, the liquid discharged from the first nozzle portion becomes smaller and it is possible to form a small dot.

In the liquid discharging head of the present application, a nozzle length of the first nozzle portion may be greater than or equal to twice a diameter of the first nozzle portion.

In the first control, the liquid is caused to flow to the liquid chamber side in a state in which the liquid adheres to the inner wall surface of the first nozzle portion and the pseudo-nozzle is formed on the inside of the liquid film covering the inner wall surface of the first nozzle portion.

A case in which the nozzle length of the first nozzle portion is twice the diameter of the first nozzle portion corresponds to a case in which the nozzle length of the first nozzle portion is a run-up section length (a run-up distance) at which the distribution of the flow velocity of the liquid in the first nozzle portion. Accordingly, when the nozzle length of the first nozzle portion is greater than or equal to twice the diameter of the first nozzle portion, the distribution of the flow velocity of the liquid in the first nozzle portion is fixed. When the pseudo-nozzle is formed under conditions under which the distribution of the flow velocity of the liquid in the first nozzle portion is fixed, as compared to a case in which the pseudo-nozzle is formed under conditions under which the distribution of the flow velocity of the liquid in the first nozzle portion is not fixed, the thickness of the liquid film covering the inner wall surface of the first nozzle portion is uniform and the thickness of the pseudo-nozzle formed inside the liquid film is uniform.

Therefore, it is preferable that the nozzle length of the first nozzle portion be greater than or equal to twice the diameter of the first nozzle portion in order to render the thickness of the pseudo-nozzle formed inside the liquid film uniform.

In the liquid discharging head of the present application, it is preferable that after inverting a shape of the center portion of the liquid surface to a protruding shape facing the distal end side, a flow velocity of an apex on the liquid chamber side of the liquid surface of the liquid become the maximum at a region of the second nozzle portion.

Since the second nozzle portion has a greater sectional area than the first nozzle portion, the flow path resistance of the second nozzle portion is smaller than the flow path resistance of the first nozzle portion. In a case in which the liquid is pressurized and the liquid is caused to flow to the distal end side, when the liquid is pressurized by the second nozzle portion in which the flow path resistance is small, it is possible to increase the flow velocity of the liquid heading to the distal end side as compared to a case in which the liquid is pressurized by the first nozzle portion in which the flow path resistance is large.

In the liquid discharging head of the present application, since the liquid is pressurized by the second nozzle portion in which the flow path resistance is small and the flow velocity of the apex on the liquid chamber side of the liquid surface of the liquid is the maximum in the second nozzle portion in which the flow path resistance is small, it is possible to increase the flow velocity of the liquid heading to the distal end side as compared to a configuration in which the flow velocity of the apex on the liquid chamber side of the liquid surface of the liquid is the maximum in the first nozzle portion in which the flow path resistance is large.

It is preferable that the liquid discharging head of the present application further include a nozzle connection portion having a tapered shape between the first nozzle portion and the second nozzle portion.

In a case in which the liquid flows from the second nozzle portion to the first nozzle portion, when the nozzle connection portion having a tapered shape is provided between the first nozzle portion and the second nozzle portion, the flowing of the liquid in the nozzle connection portion which is the boundary between the first nozzle portion and the second nozzle portion is less easily impeded, and hypothetically, even when bubbles are contained in the liquid, the bubbles are less easily retained at the nozzle connection portion which is the boundary between the first nozzle portion and the second nozzle portion.

The liquid discharging head may further include a third nozzle portion positioned closer to the liquid chamber side than the second nozzle portion and having a third sectional area larger than the second sectional area, in which in the first control, the center portion of the liquid surface may be drawn into the third nozzle portion.

Since the third nozzle portion has a larger sectional area than the second nozzle portion, the flow path resistance in the third nozzle portion is still smaller. When the center portion of the liquid surface is drawn into the third nozzle portion and the flow velocity of the apex on the liquid chamber side of the liquid surface of the liquid is the maximum in the third nozzle portion in which the flow path resistance is small, it is possible to further increase the flow velocity of the liquid heading to the distal end side as compared to a case in which the flow velocity of the apex on the liquid chamber side of the liquid surface of the liquid is the maximum in the second nozzle portion in which the flow path resistance is small.

A liquid discharging apparatus of the present application includes a transport mechanism which transports a recording medium, the liquid discharging head which discharges a liquid onto the recording medium as a droplet, and a control section which performs drive control on the liquid discharging head.

The liquid discharging head is capable of efficiently discharging the high-viscosity liquid and is capable of forming a small dot. Since the liquid discharging apparatus including the liquid discharging head efficiently discharges the high-viscosity liquid to form an image on the recording medium, it is possible to suppress a reduction in quality of the image originating in discharge faults of the liquid, and additionally, since a small dot is formed on the recording medium, it is possible to obtain an increase in the resolution of the image formed on the recording medium.

What is claimed is:

1. A liquid discharging head mounted on a liquid discharging apparatus provided with a control section which performs discharge control on a liquid as a droplet, the liquid discharging head comprising:

a first nozzle portion which discharges the liquid from a distal end and has a first sectional area, wherein a nozzle length of the first nozzle portion is greater than or equal to twice a diameter of the first nozzle portion;

a second nozzle portion which communicates with the first nozzle portion and has a second sectional area larger than the first sectional area;

a nozzle connection portion that includes an inclined surface between the first nozzle portion and the second nozzle portion, wherein the inclined surface is inclined with respect to a direction of the discharge of the liquid from the distal end, and wherein an angle between the nozzle connection portion and an inner wall surface of the second nozzle portion is an obtuse angle;

a liquid chamber which communicates with the second nozzle portion; and a pressure changing section which changes a pressure of the liquid inside the liquid chamber, wherein the pressure changing section is driven based on a drive signal from the control section, and wherein the pressure changing section decreases the pressure of the liquid inside the liquid chamber and executes a first control in which a center portion of a liquid surface of the liquid is drawn into the second nozzle portion from the first nozzle portion in a state in which an inner wall surface of the first nozzle portion is covered by a liquid film of the liquid, and the pressure changing section increases the pressure of the liquid inside the liquid chamber in a state in which the inner wall surface of the first nozzle portion is covered by the liquid film and executes a second control in which a shape of the center portion of the liquid surface is inverted to a protruding shape toward the distal end and the liquid is further discharged from the center portion of the liquid surface having the protruding shape.

2. The liquid discharging head according to claim 1, wherein after inverting the shape of the center portion of the liquid surface to the protruding shape toward the distal end, a maximum value of a flow velocity of an apex of the liquid surface closest to the liquid chamber, while the apex is inside the second nozzle portion, is higher than that while the apex is inside the first nozzle portion.

3. A liquid discharging apparatus comprising:

a transport mechanism which transports a recording medium;

a liquid discharging head which discharges a liquid onto the recording medium as a droplet, wherein the liquid discharging head comprises:

a first nozzle portion which discharges the liquid from a distal end and has a first sectional area, wherein a nozzle length of the first nozzle portion is greater than or equal to twice a diameter of the first nozzle portion;

a second nozzle portion which communicates with the first nozzle portion and has a second sectional area larger than the first sectional area;

a nozzle connection portion that includes an inclined surface between the first nozzle portion and the second nozzle portion, wherein the inclined surface is inclined with respect to a direction of the discharge of the liquid from the distal end, and wherein an angle between the nozzle connection portion and an inner wall surface of the second nozzle portion is an obtuse angle;

a liquid chamber which communicates with the second nozzle portion; and a pressure changing section which changes a pressure of the liquid inside the liquid chamber; and a control section which performs drive control on the liquid discharging head, wherein the control section drives the pressure changing section to decrease the pressure of the liquid inside the liquid chamber and executes a first control in which a center portion of a liquid surface of the liquid is drawn into the second nozzle portion from the first nozzle portion in a state in which an inner wall surface of the first nozzle portion is covered by a liquid film of the liquid, and drives the pressure changing section to increase the pressure of the liquid inside the liquid chamber in a state in which the inner wall surface is covered by the liquid film and executes a second control in which a shape of the center portion of the liquid surface is inverted to a protruding shape toward the distal end and the liquid is further discharged from the center portion of the liquid surface having the protruding shape.

* * * * *